US005419503A

United States Patent [19]

Watanabe et al.

[11] Patent Number: 5,419,503

[45] Date of Patent: May 30, 1995

[54] METHOD OF WINDING COILS OF A DEFLECTION YOKE AND AN APPARATUS FOR CARRYING OUT THE SAME

[75] Inventors: Yasuhiro Watanabe; Yoshihiko Hakozaki, both of Tokyo; Takao Kosaka, Saitama, all of Japan

[73] Assignee: Sony Corporation, Tokyo, Japan

[21] Appl. No.: 96,450

[22] Filed: Jul. 26, 1993

[30] Foreign Application Priority Data

Aug. 5, 1992 [JP] Japan ..... 4-229285
Dec. 3, 1992 [JP] Japan ..... 4-350392

[51] Int. Cl.[6] ..... H01B 11/08; H01F 7/06

[52] U.S. Cl. ..... 242/7.03; 29/605; 242/7.01

[58] Field of Search ..... 242/7.03, 7.14, 7.4 R, 242/7.01; 29/605

[56] References Cited

U.S. PATENT DOCUMENTS

| | | | |
|---|---|---|---|
| 4,093,137 | 6/1978 | Christiana et al. | 242/7.03 |
| 4,588,143 | 5/1986 | Hetzel | 242/7.03 X |
| 4,819,323 | 4/1989 | Groothoff | 242/7.03 X |
| 4,821,407 | 4/1989 | Van de Meerakker | 242/7.03 |
| 4,884,759 | 12/1989 | Nelle et al. | 242/7.14 |
| 4,946,112 | 8/1990 | Nelle et al. | 242/7.14 |
| 4,997,138 | 3/1991 | Luciani et al. | 242/7.03 |

FOREIGN PATENT DOCUMENTS 2449964 2/1980 France .
1068737 11/1963 United Kingdom .

OTHER PUBLICATIONS

IBM Technical Disclosure Bulletin, vol. 33, No. 9, Feb. 1991, Armonk, N.Y., USA, pp. 165–166.

*Primary Examiner*—Daniel P. Stodola
*Assistant Examiner*—Michael R. Mansen
*Attorney, Agent, or Firm*—Jay H. Maioli

[57] ABSTRACT

A coil winding apparatus includes a wire feed assembly having a wire feed nozzle that can be moved along a first axis (Z-axis) parallel to the center axis of a core and along a second axis (X-axis) perpendicular to the first axis and that can also be moved and positioned inside and outside the core, a guide device having a guide member is capable of catching a wire fed through the wire feed nozzle and can also be moved along the first and second axes and positioned relative to the core. A guide member guides the wire to a first circumferential groove, to a second circumferential groove, and to slots, all of which are formed in the core. A core holding device is included for holding and indexing the core during the coil winding operation.

18 Claims, 28 Drawing Sheets

METHOD OF WINDING COILS OF A DEFLECTION YOKE AND AN APPARATUS FOR CARRYING OUT THE SAME

BACKGROUND OF THE INVENTION

1. Field of the Invention

The present invention relates generally to winding coils and, more specifically, to a method and apparatus for winding the coils for a deflection yoke to be mounted on a cathode-ray tube.

2. Description of the Prior Art

The core of a conventional deflection yoke has the shape of a bobbin and is generally formed of two members. The two members are assembled to form the core, and then coils are wound around the assembled core. The strength of such a composite core formed by assembling the two members is not very great, and it is liable to be distorted after the coils have been wound thereon. It also happens that frequently the two members are not assembled correctly.

The recent development of high-quality or high definition cathode ray tubes (CRTs) and the start of high definition television (HDTV) broadcasting require high-performance deflection yokes and, to that end, a so-called integral deflection yoke has been used. In that regard, techniques for constructing a coil winding machine for winding coils of integral deflection yokes have been under development.

The wire feed nozzle and the wire guide of the conventional coil winding machine for winding the coils of an integral deflection yoke can not be inserted in the very narrow space in the core of the deflection yoke. When winding a wire around a narrow section by attaching the wire to the section from outside, it sometimes occurs that the wire cannot be satisfactorily caught by the narrow section, so that the wire is not wound properly.

The wire guide of the conventional coil winding machine for winding coils of an integral deflection yoke is able to move vertically only between fixed positions when winding the wire on the neck portion. Thus, when the wire is wound on the neck portion at a fixed position on a circumferential groove, the wire cannot be wound uniformly in the circular groove. If the wire is not wound properly or the wire is not wound in uniform coils, the deflection yoke is unable to control electron beams precisely, and hence a CRT incorporating such a deflection yoke is unable to display pictures of high quality.

SUMMARY OF THE INVENTION

Accordingly, it is an object of the present invention to provide a method of winding coils of a deflection yoke capable of accurately winding a wire in a narrow space in a core and of substantially uniformly winding a wire in a circumferential groove. It is also an object to provide a coil winding apparatus for carrying out the method.

To achieve the object, the present invention provides a coil winding apparatus for forming the coils of a deflection yoke by winding wires in a first circumferential groove formed in a funnel-shaped core, in a second circumferential groove of the core, and in a coil holding portion located between the first and second circumferential grooves. The apparatus includes a wire feed unit having a wire feed nozzle capable of being moved along a first axis parallel to the center axis of the core and along a second axis perpendicular to the first axis and capable of being moved and of being positioned inside and outside the core. A guide unit having a guide member capable of detachably holding the wire, of being moved along the first axis parallel to the center axis of the core and the second axis perpendicular to the first axis, of being moved relative to the core, and of being positioned to guide the wire to the first circumferential groove, to the second circumferential groove, and to the coil holding portion of the core. A core holding unit is provided that is capable of holding the core and of indexing and positioning the coil holding portion of the core. Preferably, the wire feed unit is provided with a moving mechanism for moving the wire feed nozzle along the first axis and the second axis perpendicular to the first axis. The operation of the feed mechanism can be controlled by a numerical control system.

The guide unit is provided with a moving mechanism for moving the guide member along the first axis and the second axis perpendicular to the first axis and, preferably, the operation of the moving mechanism is controlled by a numerical control (NC) unit. The first circumferential groove is formed in one end of the core on the side toward the fluorescent screen of the CRT, and the second circumferential groove is formed in the other end of the core on the side toward the electron gun of the CRT. The coil holding portion consists of sectional coiling grooves, and the feed nozzle of the wire feed unit can be turned in opposite directions with respect to the center axis of the core through a predetermined angle and, preferably, the turning operation of the feed nozzle is controlled by the NC unit.

The guide member of the guide unit can be turned in opposite directions with respect to the second axis, and the turning operation of the guide member can be controlled by the NC unit, as well.

The core holding unit comprises a clamping device for detachably clamping the core and a driving device capable of turning and indexing the clamping device. The driving device is also controlled by the NC unit.

The clamping device is provided with a positioning mechanism including a plurality of rollers for holding the core at its cylindrical surface to position the core, and a fixing mechanism for pressing the positioning mechanism against either a flange formed on the open side of the core or a flange on the neck side of the core to fix the core in place.

The guide member of the wire guide unit can have a shape substantially resembling the letter L, and the wire feed nozzle of the wire feed unit is provided with at least one pulley having at least one guide groove for guiding a wire.

The present invention further provides a method of winding coils of a deflection yoke, having the steps of moving the wire feed nozzle of a wire feed unit inside and outside a core along a first axis parallel to the center axis of the core and along a second axis perpendicular to the first axis, while a wire is being fed through the wire feed nozzle. Then, moving the guide member of a guide unit holding the wire that is fed through the wire feed nozzle along the first axis and the second axis, turning the core to index the same, and guiding the wire to a first circumferential groove, a second circumferential groove, and a coil holding portion, all of which are formed in the core.

The movement of the wire feed nozzle along the first and second axes and turning of the same, the movement of the guide member along the first and second axes, and the turning of the core can all be controlled by the NC unit.

The method in accordance with the present invention moves the wire feed nozzle of a wire feed unit inside and outside a core along a first axis parallel to the center axis of the core and along a second axis perpendicular to the first axis while a wire is being fed through the wire feed nozzle, moves the guide member of a guide unit holding the wire fed through the wire feed nozzle along the first axis and the second axis, turns the core to index the same and guides the wire to a first circumferential groove, a second circumferential groove and a coil holding portion formed in the core by the guide member used to wind the wire.

When the respective operations of the foregoing units are controlled by the NC unit, the operating modes of those units can be quickly changed simply by changing the control parameters used for the numerical control. Therefore, the operating modes of the units can be easily changed according to the particular specifications of deflection yokes to be manufactured and a highly efficient, highly accurate coil winding operation is possible, so that high-performance deflection yokes can be manufactured.

According to another embodiment of the present invention, the wire feed nozzle and the guide unit can be accurately positioned relative to the core, particularly, relative to the first circumferential groove, the second circumferential groove, and the coil holding portion. Accordingly, even if the respective widths of the first and second circumferential grooves are small, the wire can be orderly and uniformly wound in the first and second circumferential grooves. Furthermore, in the interval between the section on the side of the larger end of the core and the section on the side of the smaller end of the core, the wire can be accurately wound in the sections. Thus, a high-performance deflection yoke can be obtained, which makes possible the mass production of high definition CRTs.

When the servomotors, cylinder actuators and the like of the coil winding apparatus are controlled by the NC unit, the operating mode of the coil winding apparatus can be easily completed without requiring much time to manufacture different types of deflection yokes because control data and control parameters for numerical control can be easily changed, which improves the productivity of the associated production lines.

The above and other objects, features and advantages of the present invention will become more apparent from the following description taken in connection with the accompanying drawings.

DETAILED DESCRIPTION OF PREFERRED EMBODIMENTS

Figure 1:
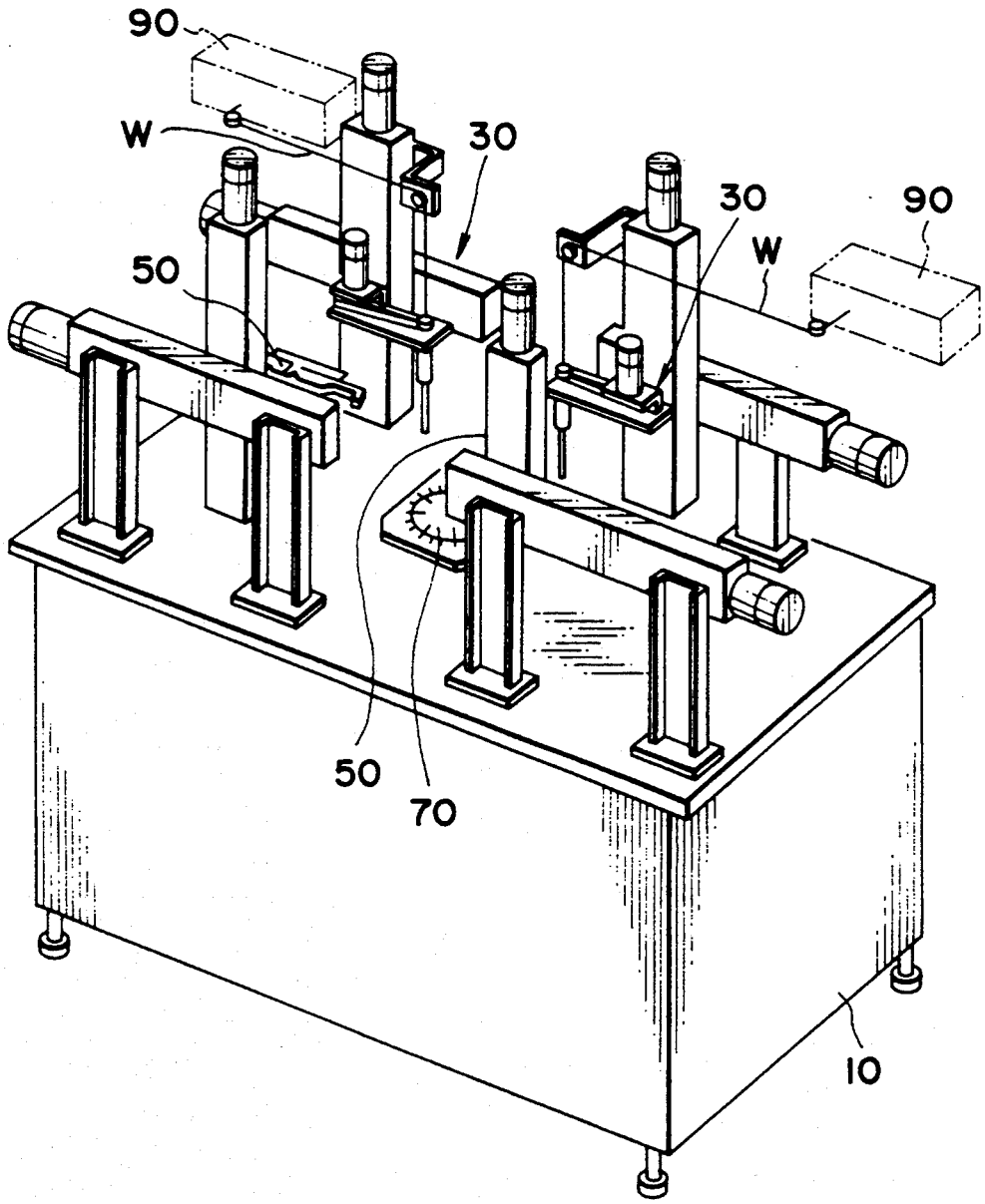
FIG. 1 is a perspective view of a coil winding apparatus according to an embodiment of the present invention.
Figure 2:
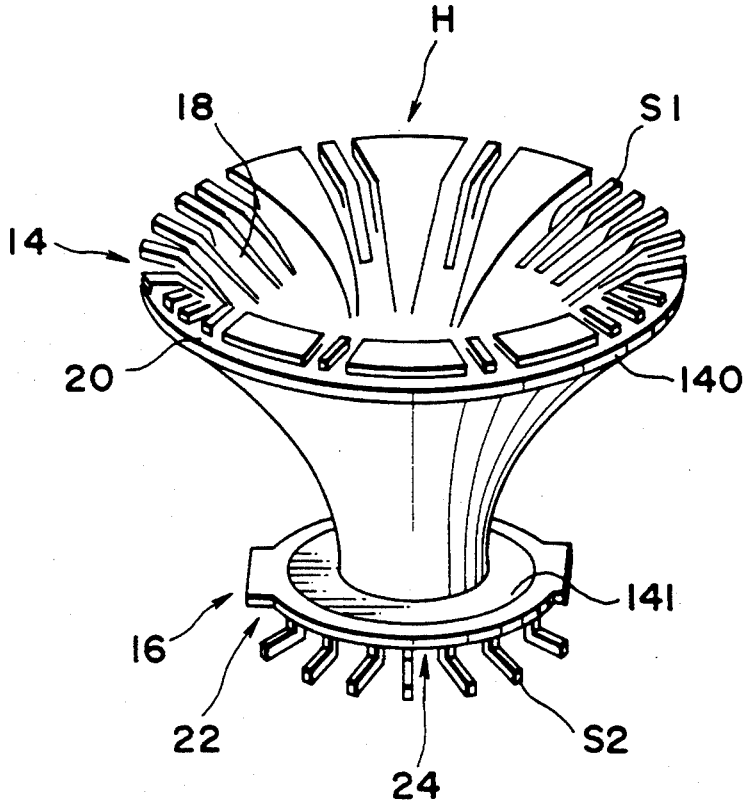
FIG. 2 is a perspective view of a core on which coils are formed by the coil winding apparatus of FIG. 1 to form a deflection yoke.

In FIG. 1 a coil winding apparatus according to the present invention winds coils on a funnel-shaped core H, as shown in FIG. 2, to form a deflection yoke for a cathode ray tube (CRT).

Figure 3:
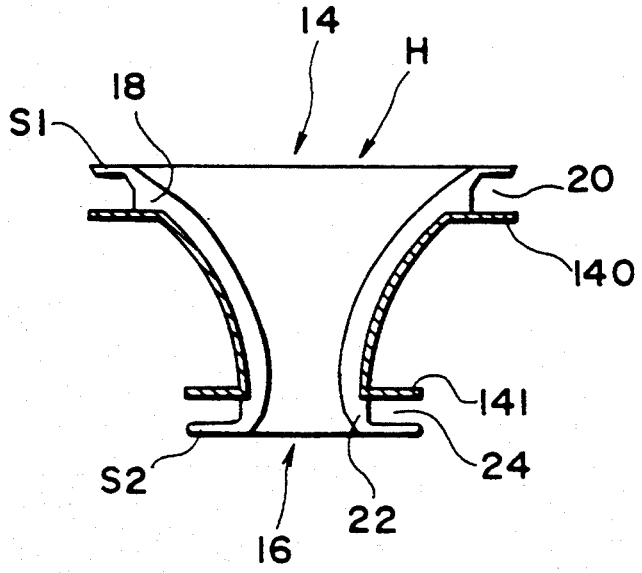
FIG. 3 is a longitudinal sectional view of the core of FIG. 2.

The construction of the core H is shown in FIGS. 2 and 3, in which the core H is a solid section core serving as a spool on which a wire is wound. The core H is formed of plastic and has a larger end 14 and a smaller end 16. The core H is mounted on a CRT, not shown, with the larger end 14 positioned on the side of the fluorescent screen of the CRT and the smaller end 16 positioned on the side of the electron gun of the CRT. As shown in FIGS. 2 and 3, the larger end 14 of the core H is provided with a plurality of sections S1, a plurality of slots 18, and a first circumferential groove 20. The smaller end 16 of the core H is provided with a plurality of sections S2, a plurality of slots 22, and a second circumferential groove 24.

Turning back to FIG. 1, a coil winding apparatus is shown that can simultaneously wind at least two wires W on the core H. More specifically, the coil winding apparatus comprises a pair of wire feed units 30, a pair of guide units 50, a core holding unit 70, a pair of tension units 90, and a base frame 10 supporting the above-mentioned units. Since the pair of wire feed units 30, the pair of guide units 50, and the pair of tension units 90 are symmetrical and substantially identical in construction, respectively, it is necessary to describe only the wire feed unit 30, the guide unit 50 and the tension unit 90 installed in the left-hand portion of the machine shown in FIG. 1.

Figure 4:
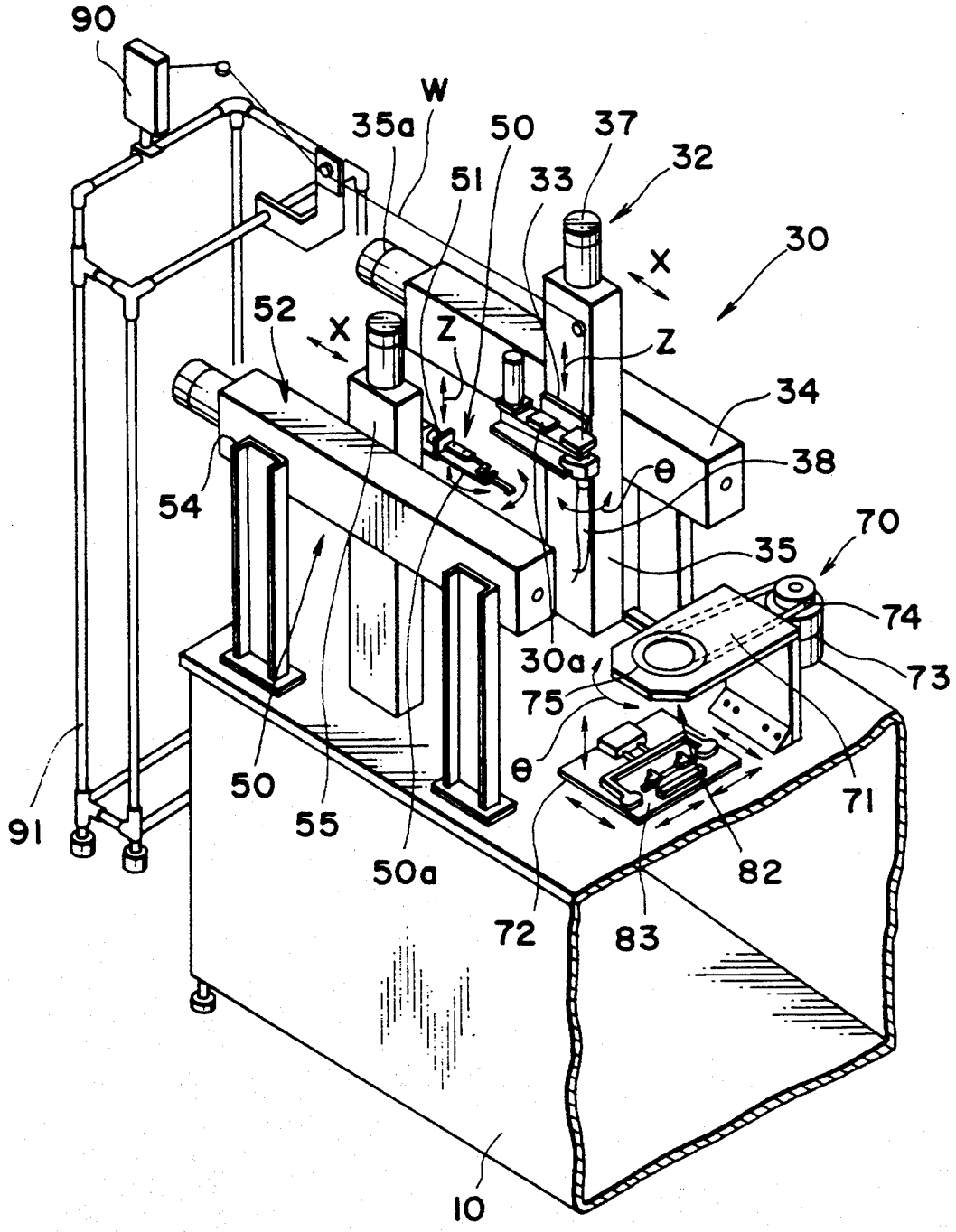
FIG. 4 is an enlarged perspective view of a portion of the coil winding apparatus of FIG. 1.
Figure 5:
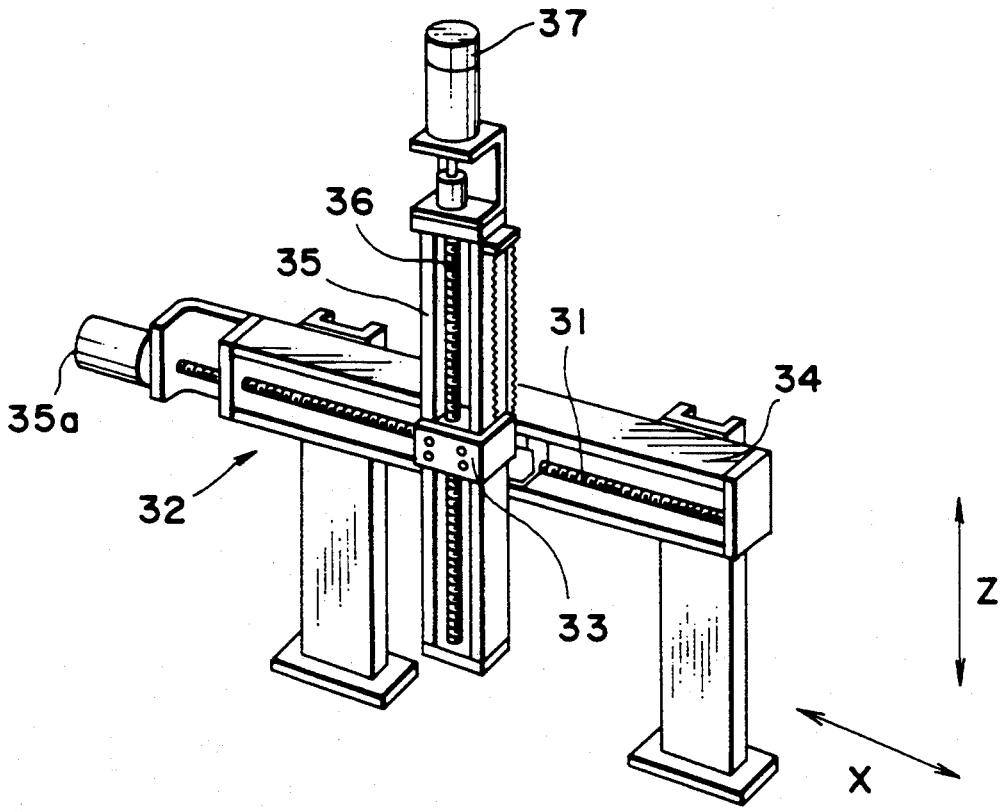
FIG. 5 is an XZ-feed unit for feeding wire in the coil winding apparatus of FIG. 1.

FIG. 4 shows the wire feed unit 30, the guide unit 50, the core holding unit 70 and the tension unit 90 mounted on the left-hand portion of the base frame 10, and FIG. 5 shows the XZ wire feed structure 32 in more detail. In FIGS. 4 and 5, the wire feed unit 30 comprises a nozzle 38, a nozzle turning unit 30*a* and the XZ-feed unit 32. The nozzle turning unit 30*a* is fixed on a sliding plate 33 included in the XZ-feed unit 32. The XZ-feed unit 32 has an X-axis sliding unit 34 that slides along an X-axis and a Z-axis sliding unit 35 that slides along a Z-axis perpendicular to the X-axis. The X-axis sliding unit 34 is fixed on the base frame 10. The feed screw 31 of the X-axis sliding unit 34 is rotated by a servomotor 35*a* in response to control pulses to move the Z-axis sliding unit 35 along the X-axis. The feed screw 36 of the Z-axis sliding unit is rotated by a servomotor 37 in response to control pulses to move the sliding plate 33 along the Z-axis for positioning. Thus, the wire feed unit 30 can be moved along the X-axis and the Z-axis. The servomotors 35*a* and 37 are driven by a servodriver controlled by a numerically controlled (NC) unit 170, which will be described later.

Figure 6:
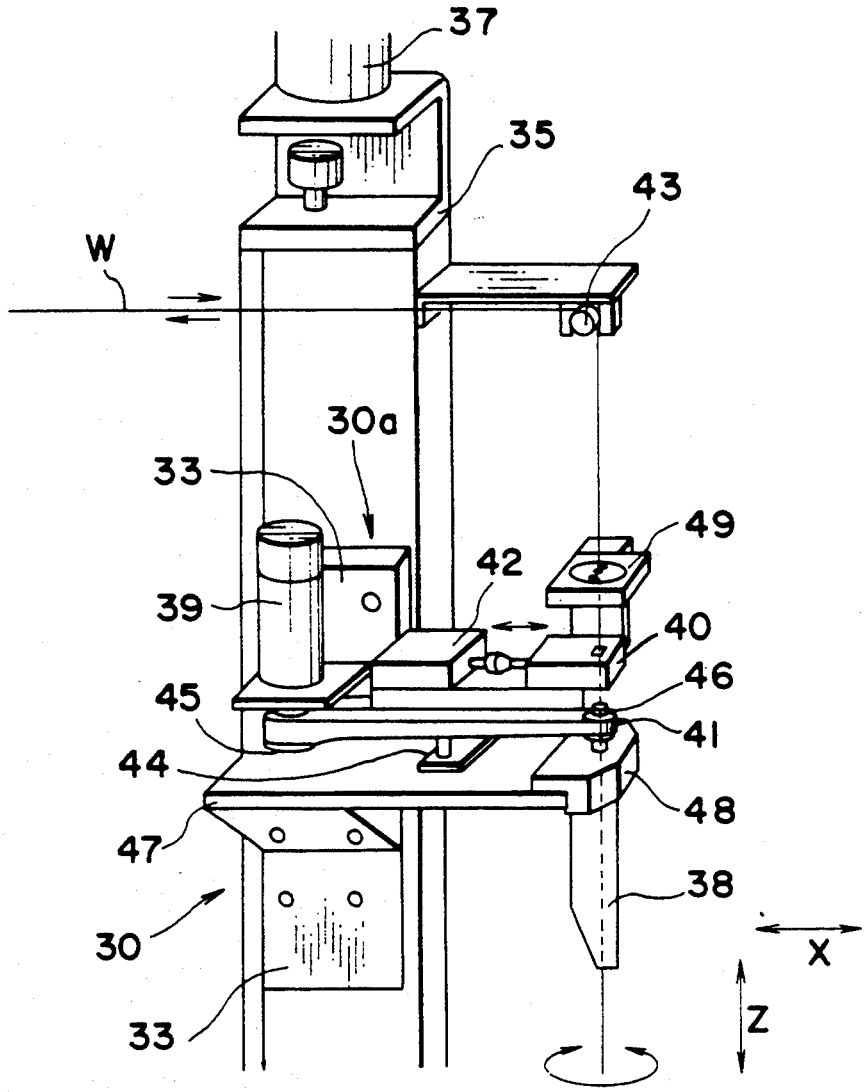
FIG. 6 is a perspective view of the wire feed unit of the coil winding apparatus of FIG. 1.

Referring to FIG. 6, the wire feed unit 30 feeds a wire W through the tension unit 90 to the core H. The wire feed unit 30 includes the nozzle 38, a servomotor 39, a gripper 40, a toothed belt 41, a cylinder actuator 42, a pulley 43, an idler pulley 44, toothed pulleys 45 and 46, a sliding base 47, a bearing housing 48, and a guide unit 49.

Figure 7:
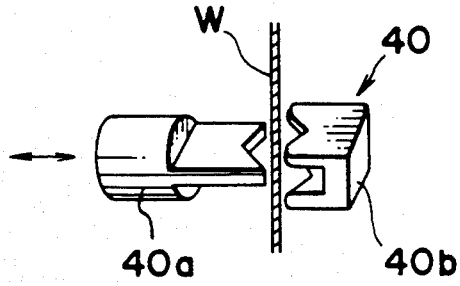
FIG. 7 is a perspective view of a wire clamping mechanism included in the wire feed unit of FIG. 6.
Figure 8:
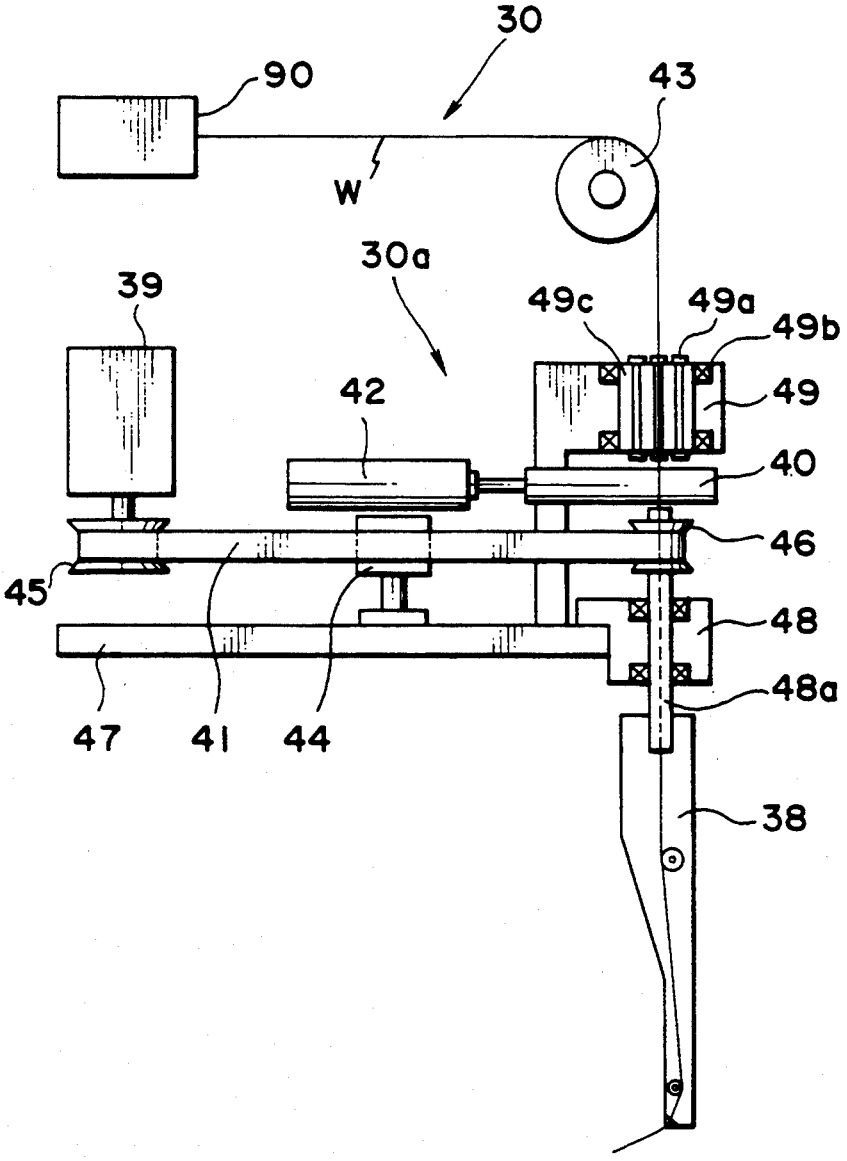
FIG. 8 is a side view of the wire feed unit of FIG. 6.

FIG. 8 shows the nozzle turning unit 30*a*, wherein the nozzle 38 is fixed to a shaft 48*a*, which can be turned in the normal direction through a predetermined angle Θ, for example, 180°, as well as in the reverse direction through the predetermined angle Θ, through the toothed belt 41, and the toothed pulleys 45 and 46 by the servomotor 39. The total turning amount for shaft 48*a* in the normal and reverse directions is 360°. When the coil winding apparatus is stopped, the gripper 40 grips the wire W. As shown in FIG. 7, the gripper 40 has a gripping pin 40*a* connected to the operating shaft of the pneumatic cylinder actuator 42, and a fixed pin 40*b*. When gripping the wire W between the gripping pin 40*a* and the fixed pin 40*b*, the operating shaft of the pneumatic cylinder actuator 42 is extended to advance the gripping pin 40*a* toward the fixed pin 40*b*. The servomotor 39 is driven by a servodriver by the NC unit 170, which will be described later. The pneumatic cylinder actuator 42 is also controlled by the NC unit 170.

Figure 9:
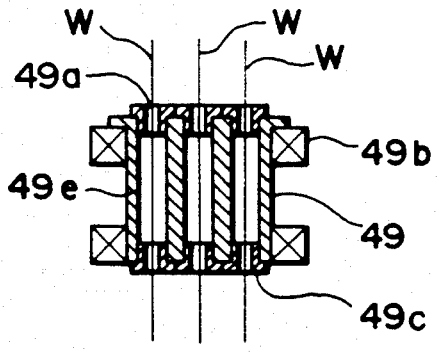
FIG. 9 is a sectional view of a wire guide unit included in the wire feed unit of FIG. 8.

As shown in FIGS. 8 and 9, the guide member 49*c* of the guide unit 49 is provided with a plurality of guide holes 49*a*, for example, three guide holes 49*a*, to guide up to three wires W, so that the wires W do not become entangled. The guide member 49*c* is supported in bearings 49*b* so that the guide member 49*c* is able to turn according to the movements of the nozzle 38.

Figure 10:
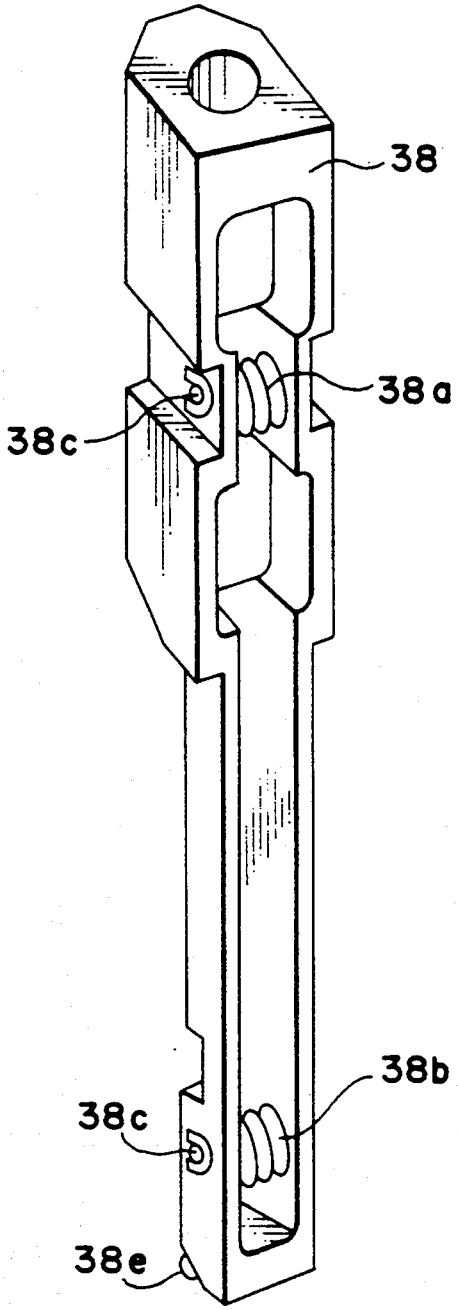
FIG. 10 is a perspective view of a nozzle of the wire feed unit of FIG. 8.
Figure 11:
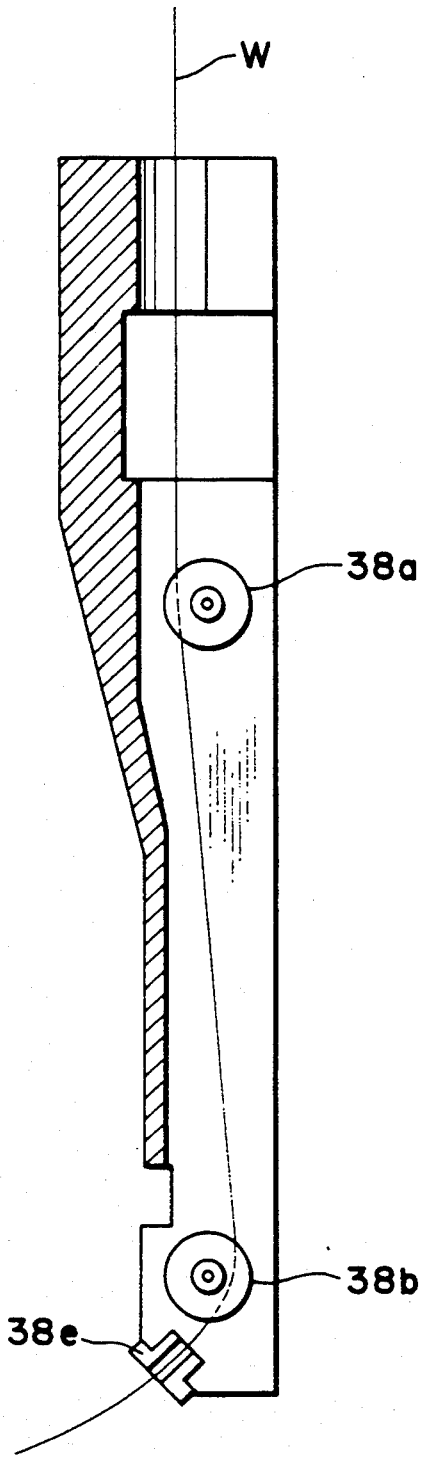
FIG. 11 is a sectional view of the nozzle of unit FIG. 10.
Figure 12:
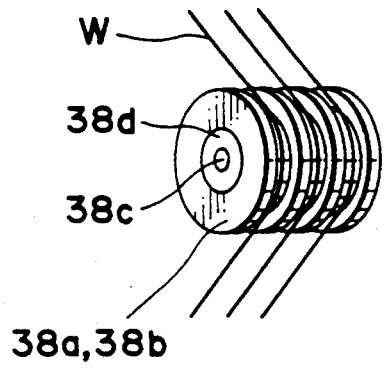
FIG. 12 is a perspective view of rollers included in the nozzle of the wire feed unit of FIG. 8.
Figure 13:
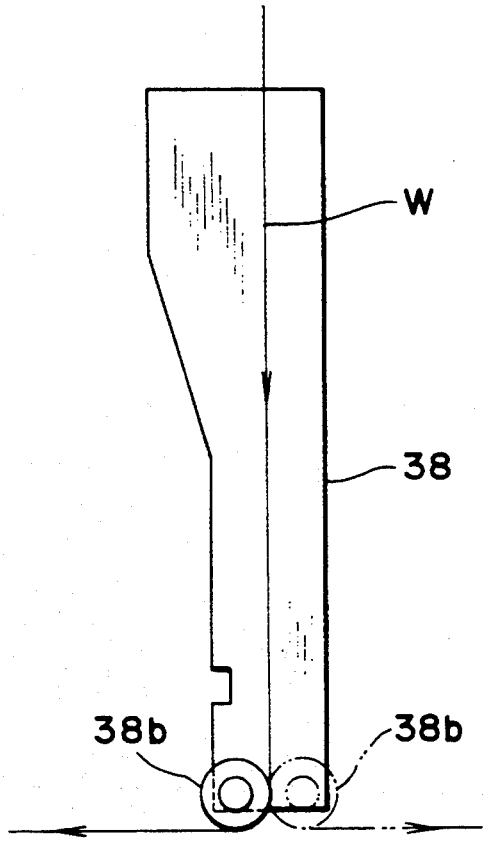
FIG. 13 is a side view of a modification of the nozzle of the wire feed unit of FIG. 8.

Referring to FIGS. 10, 11, and 12, the nozzle 38 is provided with two grooved guide rollers 38*a* and 38*b*. Each of the grooved guide rollers 38*a* and 38*b* is provided with three guide grooves and is supported for rotation by bearings 38*d* on a pin 38*c* to guide up to three wires W. As shown in FIGS. 6 and 8, the wire W fed via the tension unit 90 travels through the guide pulley 43, the gripper 40, and the nozzle 38, and the wire W is fed through a guide member 38*e* attached to the extremity of the nozzle 38. The nozzle 38 may be provided with two guide rollers 38*b*, as shown in FIG. 13, to feed the wire W in either of two opposite directions, instead of turning the nozzle 38 to change the direction of feed of the wire W.

The guide unit 50 shown in FIG. 4 has a guide operating unit 50*a*, a reversing unit 51, and an XZ-feed unit 52, which is similar in construction to the XZ-feed unit 32. The XZ-feed unit 52 has an X-axis sliding unit 54 and a Z-axis sliding unit 55. The sliding base 53, which is attached to the wire feed unit 30, can be moved by a servomotor, not shown, for positioning along the X-axis and the Z-axis. The servomotor is driven by a servodriver controlled by the NC unit 170.

Figure 14:
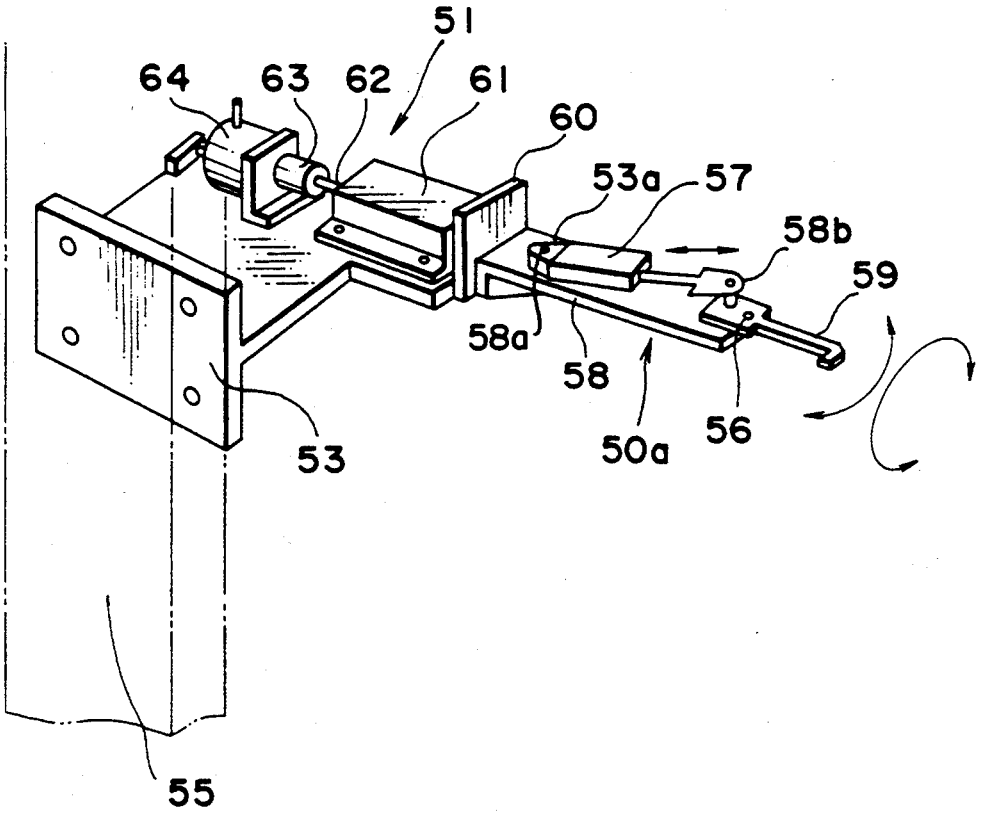
FIG. 14 is a perspective view of a guide unit included in the coil winding apparatus of FIG. 1.
Figure 15:
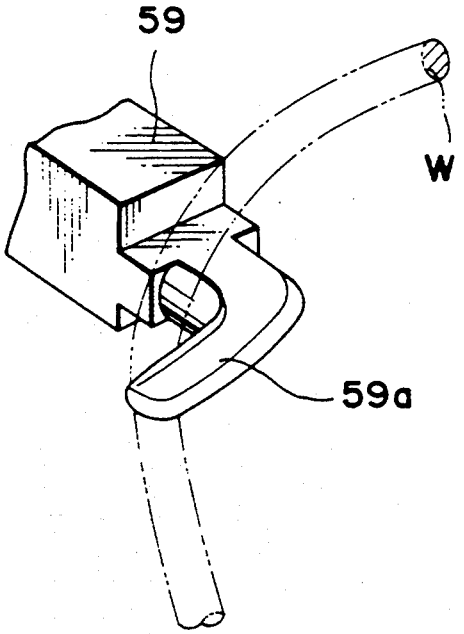
FIG. 15 is an enlarged perspective view of a guide finger included in the guide unit of FIG. 14.

FIG. 14 shows the guide operating unit 50*a* and the reversing unit 51 of the guide unit 50 in more detail. The guide operating unit 50*a* has a guide finger 59, a cylinder actuator 57, and a base 58. The rear end of the cylinder actuator 57 is joined pivotally with a pin 58*a* to the base 58, and the front end of the cylinder actuation 57 is joined pivotally with a pin 58*b* to the guide finger 59 to turn the guide finger 59 on a pin 56. When the operating shaft of the cylinder actuator 57 is retracted, the guide finger 59 turns on the pin 56 in an opening direction and, when extended, in a closing direction. Preferably, the guide finger 59 is provided with an L-shaped tip 59*a* as shown in FIG. 15. The operation of the cylinder actuator 57 is controlled by the NC unit 170, which will be described later.

The reversing unit 51 has a reversing base 60, a bearing housing 61, a reversing shaft 62, a coupling 63, a rotary actuator 64, and a sliding base 53. When the operating shaft of the rotary actuator 64 is turned pneumatically through an angle of 180°, the reversing shaft 62 connected to the output shaft of the rotary actuator 64 turns the reversing shaft 62 and the reversing base 60 through an angle of 180° in the reverse direction to turn the guide finger 59 together with the base 58 in the reverse direction.

The tension unit 90 is attached to a frame 91 as shown in FIG. 4. The tension unit 90 mechanically tensions the wire W supplied from a wire supply source, not shown, to supply the wire W to the wire feed unit 30 at an appropriate tension.

Figure 16:
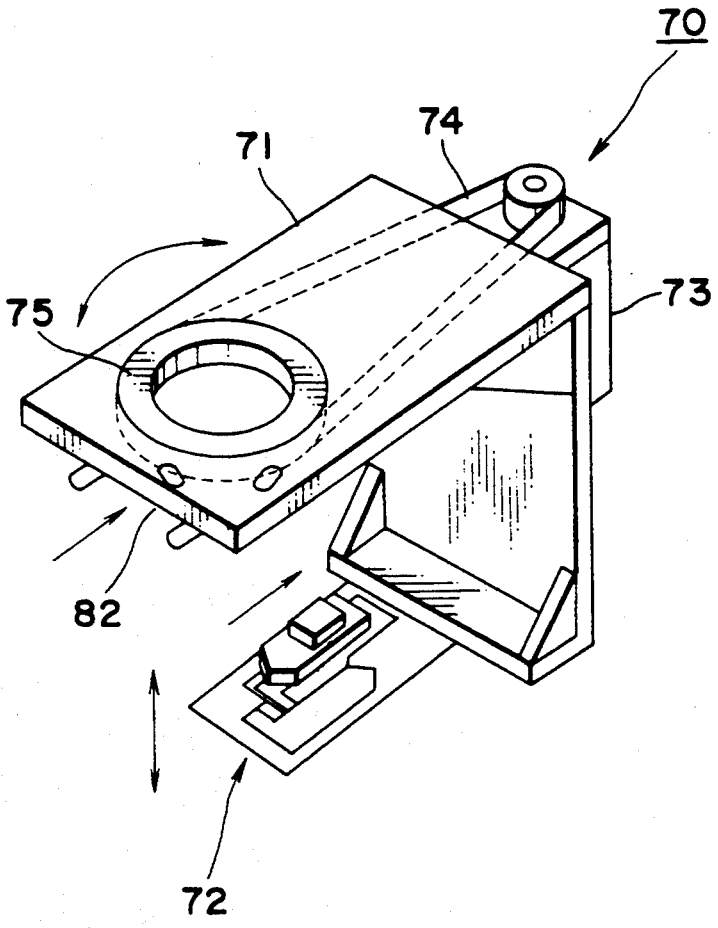
FIG. 16 is a perspective view of a core holding unit included in the coil winding apparatus of FIG. 1.

The core holding unit 70 shown in FIG. 4 holds the core H shown in FIG. 2 and indexes the core H. As shown in FIG. 16, the core holding unit 70 has a holding plate 71, a rotary table 75 supported on the holding plate 71, a clamping unit 82 mounted on the holding plate 71 to hold the core H on the rotary table 75, and a clamp operating device 72. The rotary table 75 is turned for indexing through a toothed belt 74 by a servomotor 73.

Figure 17:
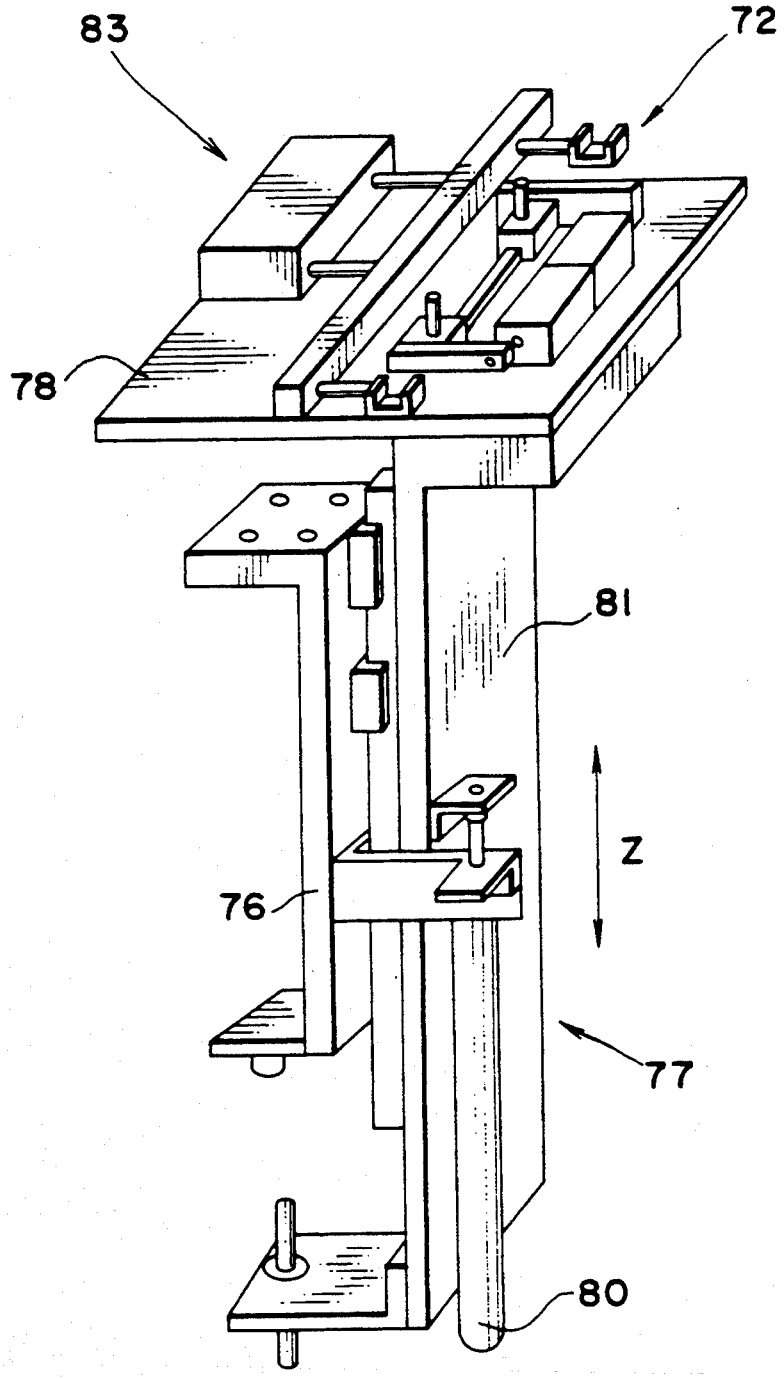
FIG. 17 is a perspective view of a clamp operating device included in the coil winding apparatus of FIG. 1.

Referring to FIG. 17, the clamp operating device 72 has a fixed plate 76 fixed to the base frame 10 (FIG. 4), a moving unit 77 capable of vertical movement, a lifting table 78 and an operating unit 83. The moving unit 77 has a cylinder actuator 80 fixedly held on the fixed plate 76, and a moving plate 81. When the operating shaft of the cylinder actuator 80 is extended, the moving plate 81 is moved through a predetermined distance along the Z-axis together with the lifting table 78 and the operating unit 83 to position the operating unit 83. The operation of the cylinder actuator 80 is controlled by the NC unit 170, which will be described later.

Figure 18:
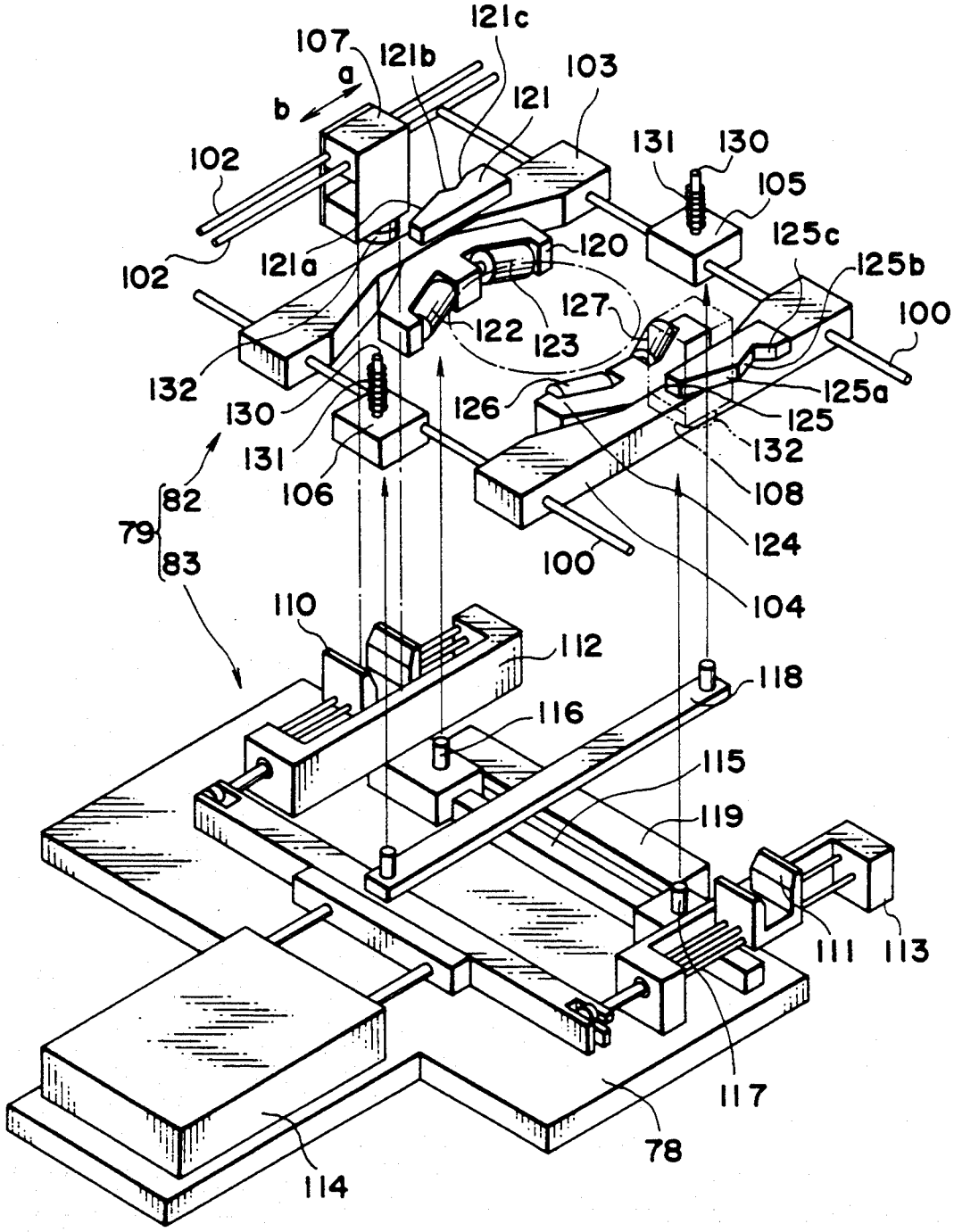
FIG. 18 is a perspective view of a clamping unit and a clamp operating unit included in the coil winding apparatus of FIG. 1.

Referring to FIG. 18, a core holder operating unit 79 comprises a clamping unit 82 and the operating unit 83. The clamping unit 82 is disposed under the holding plate 71 (FIG. 4), and the operating unit 83 is mounted on the lifting table 78, as shown in FIG. 17.

The clamping unit 82 comprises a pair of guide shafts 100, two pairs of left and right guide shafts 102 (only one pair of guide shafts 102 is shown in FIG. 18 for simplicity), a pair of sliders 103 and 104, a pair of guide shaft fixing blocks 105 and 106, and a pair of elastic sliders 107 and 108.

The operating unit 83 comprises operating members 110 and 111 for operating the elastic sliders 107 and 108, guide members 112 and 113 for linearly guiding the operating members 110 and 111, cylinder actuators 114 and 119, a guide rail 115, operating pins 116 and 117 for operating the sliders 103 and 104, and a pusher 118. The operation of the cylinder actuators 114 and 119 is controlled by the NC unit 170, which will be described later.

Figure 19:
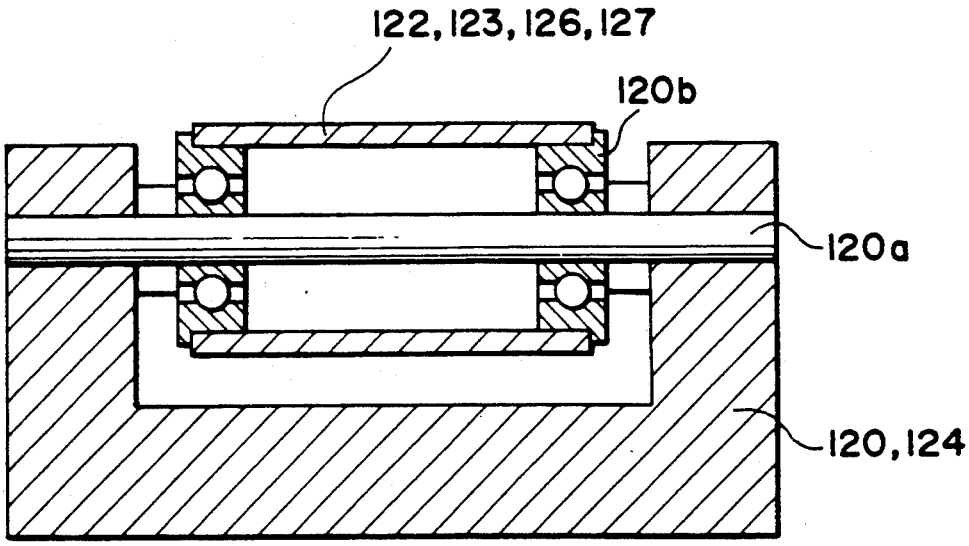
FIG. 19 is a sectional view of a roller support structure included in the core holder operating unit of FIG. 18.

The pair of guide shafts 100 extend horizontally on the lower surface of the holding plate 71 and the two pairs of left and right guide shafts 102 are extended perpendicularly to the guide shafts 100 parallel to each other. The sliders 103 and 104 are guided by the guide shafts 100 and a roller support member 120 and a plate cam 121 are fixed to the slider 103. Two rollers 122 and 123 are supported on the roller support member 120. The plate cam 121 is provided with cam surfaces 121*a*, 121*b* and 121*c*. Similarly, another roller support member 124 and a plate cam 125 are fixed to the slider 104, and two more rollers 126 and 127 are supported on the roller support member 124. The plate cam 125 is also provided with cam surfaces 125*a*, 125*b* and 125*c*. As shown in FIG. 19, the roller 122, as are rollers 123, 126 and 127, is supported for rotation by bearings 120*b* on a shaft 120*a* supported on the roller support member 120 (124). The rollers 122 and 123 are disposed in a V-shaped arrangement, and likewise the rollers 126 and 127 are disposed in an opposing V-shaped arrangement.

The guide shaft fixing blocks 105 and 106 are supported respectively on the guide shafts 100. A pin 130 is fixed to each of the guide shaft fixing blocks 105 and 106, and a compression coil spring 131 is put over each pin 130. The elastic sliders 107 and 108 are guided respectively by the two pairs of left and right guide shafts 102. A cam follower 132 is supported on the lower surface of each of the elastic sliders 107 and 108.

As shown in FIG. 18, the guide members 112 and 113 supporting the operating members 110 and 111 are moved simultaneously along the guide shafts 102 by the cylinder actuator 114. The operating pins 116 and 117 can be moved simultaneously toward or away from each other by the cylinder actuator 119. The operating pins 116 and 117 are detachably connected respectively to move the sliders 103 and 104 simultaneously toward or away from each other. The pusher 118 is fixed to the lifting table 78. When the lifting table 78 is raised, the pusher 118 engages the guide shaft fixing blocks 105 and 106 to lift the clamping unit 82 together with the guide shaft fixing blocks 105 and 106 against the resilience of the compression coil springs 131.

Figure 20:
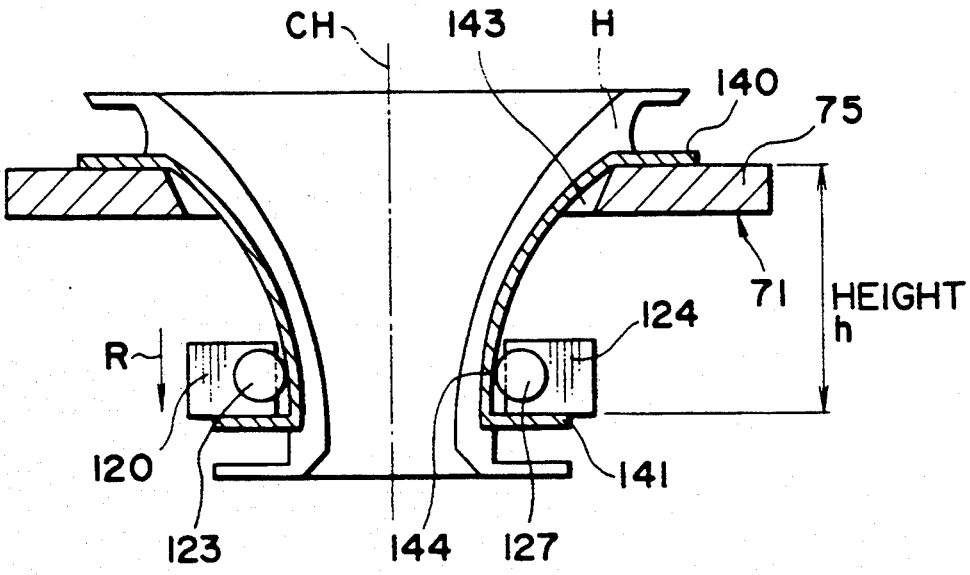
FIG. 20 is a longitudinal sectional view of a core fixed in place in the clamping unit of FIG. 18.

Referring to FIG. 20, the core H has a large flange 140 formed in the larger end 14, and a small flange 141 formed in the smaller end 16. The core H is fitted in the hole 143 of the rotary table 75 supported on the holding plate 71 with the lower surface of the larger flange 140 seated on the rotary table 75. The hole 143 is large enough for the smaller flange 141 to pass therethrough. The rotary table 75 is provided with a projection, not shown, fitting into a recess formed in the larger flange 140 to restrain the core H from turning relative to the rotary table 75.

When mounting the core H on the rotary table 75, the four rollers 122, 123 and 126, 127 (FIG. 18) are retracted so that the rollers 122, 123 and 126, 127 will not interfere with the smaller flange 141. Because the pairs of rollers 122, 123 and 126, 127 are disposed in an opposing V-shape arrangement, all the rollers 122, 123 and 126, 127 can be brought into contact with the cylindrical circumference of the core H. The four rollers are used for clamping the plastic core H so that the core H is deformed uniformly by the clamping force. Generally, the core H can be held at only three points, with a pair of rollers disposed in a V-shaped arrangement and one roller disposed opposite the apex of the pair of rollers. On the other hand, to hold a core having a cylindrical portion having a greater diameter and a relatively small wall thickness, five or more rollers may be used.

The clamping force is applied to the cylindrical portion of the core H with the four rollers in the following manner. As the elastic sliders 107 and 108 (FIG. 18) are moved along the guide shafts 102, the cam followers 132 roll along the respective cam surfaces 121*a* and 125*a* of the plate cams 121 and 125 to a position between the cam surfaces 12l*b* and 121*c* and a position between the cam surfaces 125*b* and 125*c*, respectively. In this state, the elastic sliders 107 and 108 are bent away from each other to press the sliders 103 and 104 toward each other. The elastic sliders 107 and 108 can be moved respectively by the operating members 110 and 111o When the operating members 110 and 111 are reversed, the cam followers 132 move away from the plate cams 121 and 125 to remove the clamping force from the core H.

In the state shown in FIG. 20, the core H is clamped with the larger flange 140 seated on the rotary table 75. After centering the core H by applying the rollers to the cylindrical portion 144, the roller support members 120 and 124 depress the core H at the smaller flange 141 in the direction of the arrow R for positioning and fixing. In this state, the projection of the rotary table 75 is fitted in the recess (not shown) of the large flange 140 to restrain the core H from turning relative to the rotary table 75.

Figure 21:
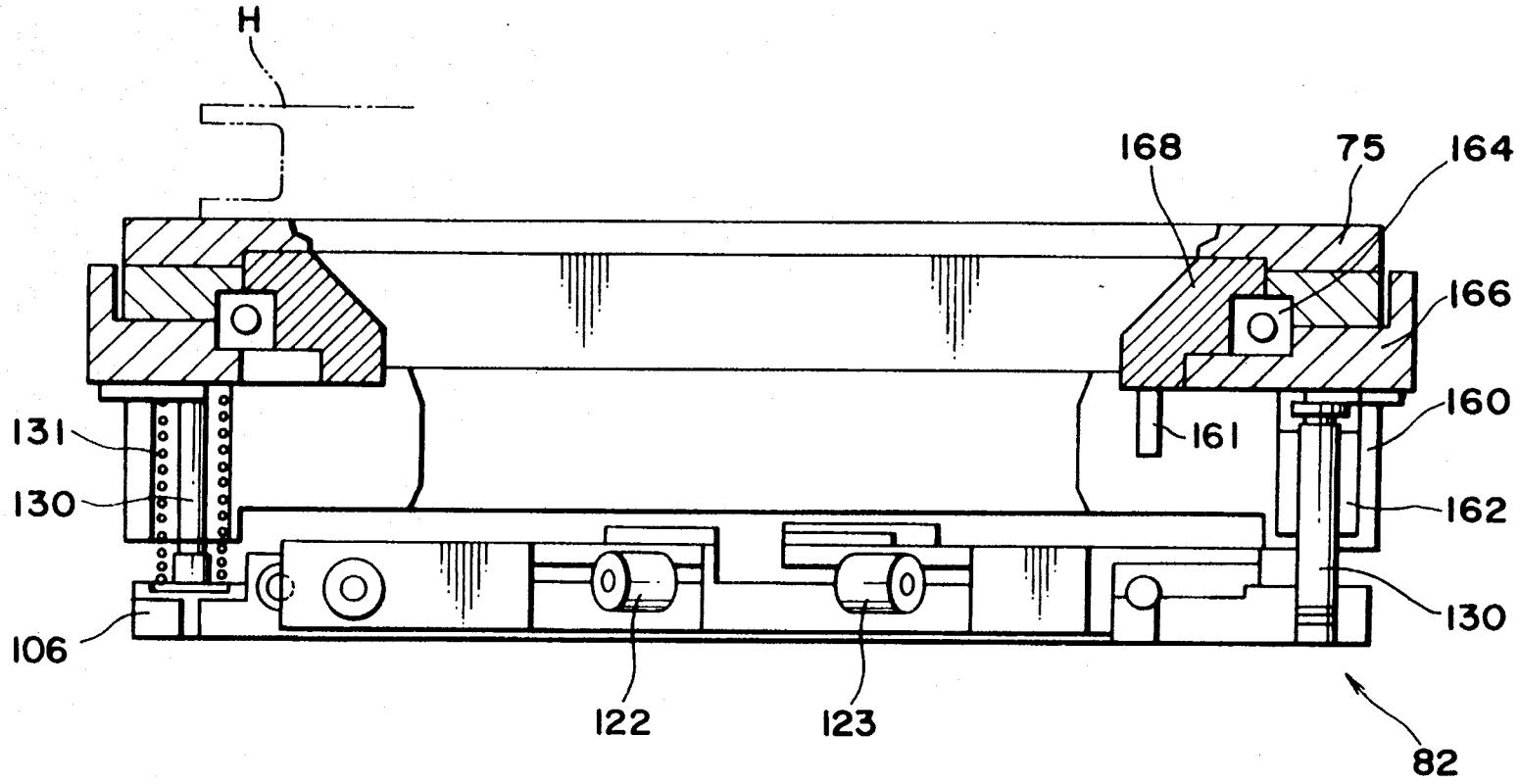
FIG. 21 is a front view in partial cross section of a core holding/rotating mechanism.

An indexing mechanism for turning and indexing the core H will be described with reference to FIG. 21, in which the core H is not shown. In FIG. 21, the clamping unit 82 of the core holder operating unit 79 (FIG. 18) is combined with a toothed pulley 160. The pins 130 are inserted in linear bearings 162, and the clamping unit 82 can be moved with only a light force along the axes of the pins 130.

The linear bearings 162 are fixed to the toothed pulley 160. The rotation of the toothed pulley 160 is transmitted through the pins 130 to the clamping unit 82. The outer ring of a bearing 164 is fixed to a base 166 and the inner ring of the bearing 164 is rotatable. The rotary table 75, a rotary ring 168, and the toothed pulley 160 are supported on the inner ring of the bearing 164 for simultaneous rotation. More specifically, the rotary ring 168 is fixed to the inner ring of the bearing 164; the rotary table 75 is fixed to the rotary ring 168; and a pin 161 protrudes downward from the rotary ring 168 into the toothed pulley 160. A toothed belt, not shown in FIG. 21 but shown at 74 in FIG. 4, is wound round the toothed pulley 160. Thus, the inner ring of the bearing 164 is turned by the servomotor 73 (FIG. 4) to turn the core H together with the rotary table 75 and the clamping unit 82 through an angle of 360° or through some other desired angle to index the core H.

The clamping unit 82 is biased continuously downward by the two compression coil springs 131 to depress the core H at the small flange 141 (FIG. 20) downwardly, so that the large flange 140 of the core H is pressed firmly against the rotary table 75.

In clamping the core H the pair of sliders 103 and 104 (FIG. 18) are moved away from each other respectively by the operating pins 116 and 117, the elastic sliders 107 and 108 are moved to their respective standby positions by the operating members 110 and 111, and then the core H is inserted in the rotary table 75 (FIG. 20). In this state, the lifting table 78 (FIG. 18) is raised to compress the compression coil springs 131 with the pusher 118 so that the core H is positioned vertically. Then, the operating members 110 and 111 move the elastic sliders 107 and 108 so that the cam followers 132 drop into the V-shaped recesses of the plate cams 121 and 125, respectively. Consequently, the core H is positioned with respect to the vertical direction, that is, a first direction parallel to the center axis CH of the core H, and to the horizontal direction, that is, a second direction, with the rollers 122, 123, 126 and 127 of the sliders 103 and 104, and the rotary table 75 as shown in FIG. 20. Then, the pusher 118 is lowered. As shown in FIG. 20, the position of the rotary table 75 relative to the roll support member 124 is indicated by clamping height h.

Figure 22:
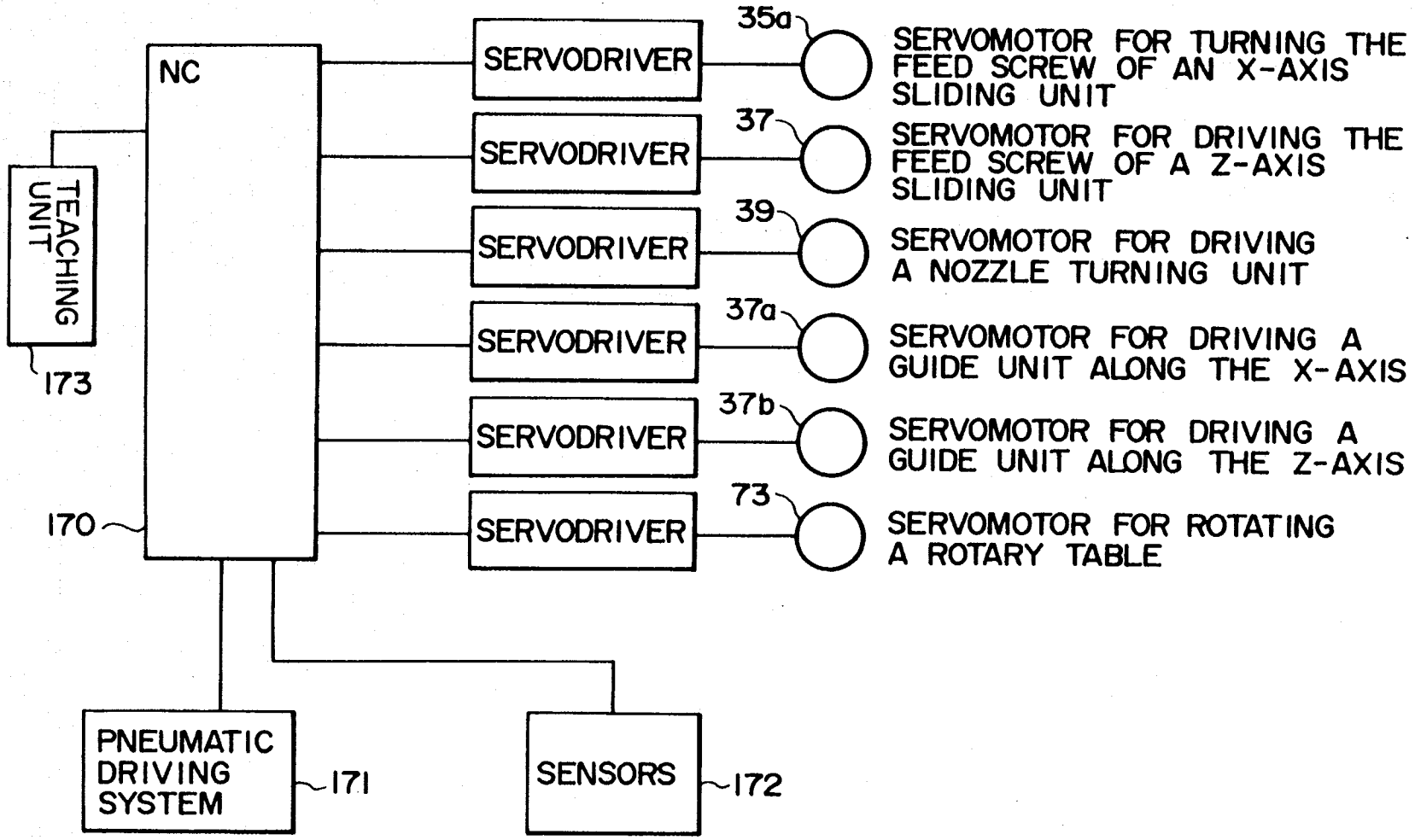
FIG. 22 is a block diagram of a control system used with the coil winding apparatus of FIG. 1.

As shown in FIG. 22, the servomotors 35a, 37 and 39 of the wire feed unit 30, the X-axis servomotors 37a and the Z-axis servomotor 37b of the guide unit 50, and the servomotor 73 for turning the core holding unit 70 are driven by servodrivers numerically controlled by the NC unit 170. The cylinder actuators of the component units are driven by a pneumatic driving system 171 that is numerically controlled by the NC unit 170. The sensors 172 associated with the pneumatic cylinder actuators detect the conditions of the pneumatic cylinder actuators and give detection signals to the NC unit 170. Data for numerical control is provided upon start-up to the NC unit 170 by operating a teaching unit 173 that can comprise a manual keyboard, for example. Data of parameters given beforehand to the NC unit 170 can be easily altered by giving correction data to the NC unit 170 by operating the teaching unit 173 when the deflection yoke is changed.

Figure 23:
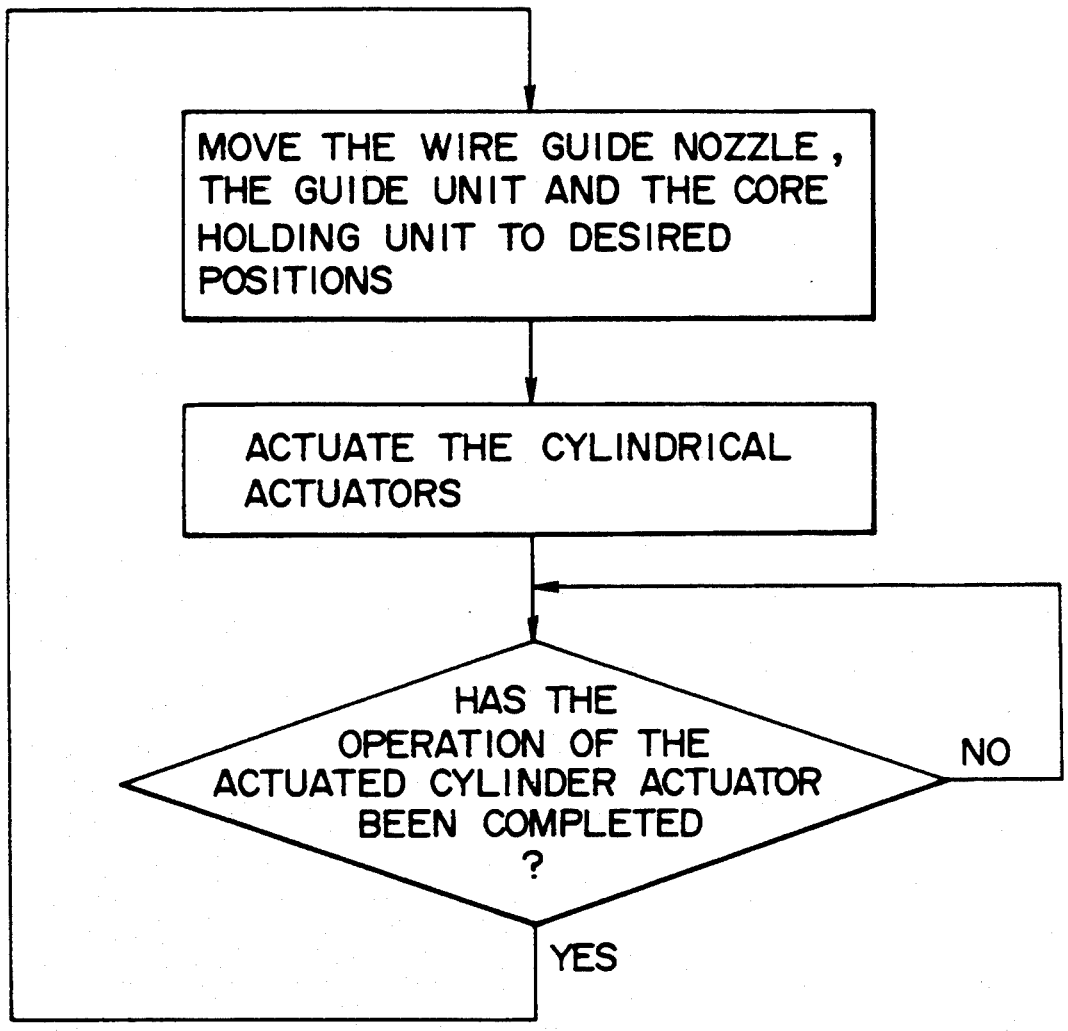
FIG. 23 is a flow chart of a control program to be executed by the control system of FIG. 22.

The NC unit 170 controls the servomotors according to a control program shown in FIG. 23 to position the wire feed unit 30, the guide unit 50 and the core holding unit 70 respectively at desired positions. Then, the NC unit 170 operates the clamping unit 82, the guide finger 59 and other necessary components and moves the core holding unit 70 vertically by controlling the cylinder actuators. Upon detecting the completion of operation of each cylinder actuator by the associated sensor, the NC unit 170 stops the cylinder actuators.

A method of winding the wire W on the core H using this coil winding apparatus of the present invention as shown in FIG. 1 will now be described. The coil winding apparatus shown in FIG. 1 can simultaneously wind two wires W on the core H or up to six wires W on the core H. Accordingly, the productivity of the coil winding apparatus is at least twice that of the coil winding apparatus capable of winding only a single wire at a time.

Figure 24:
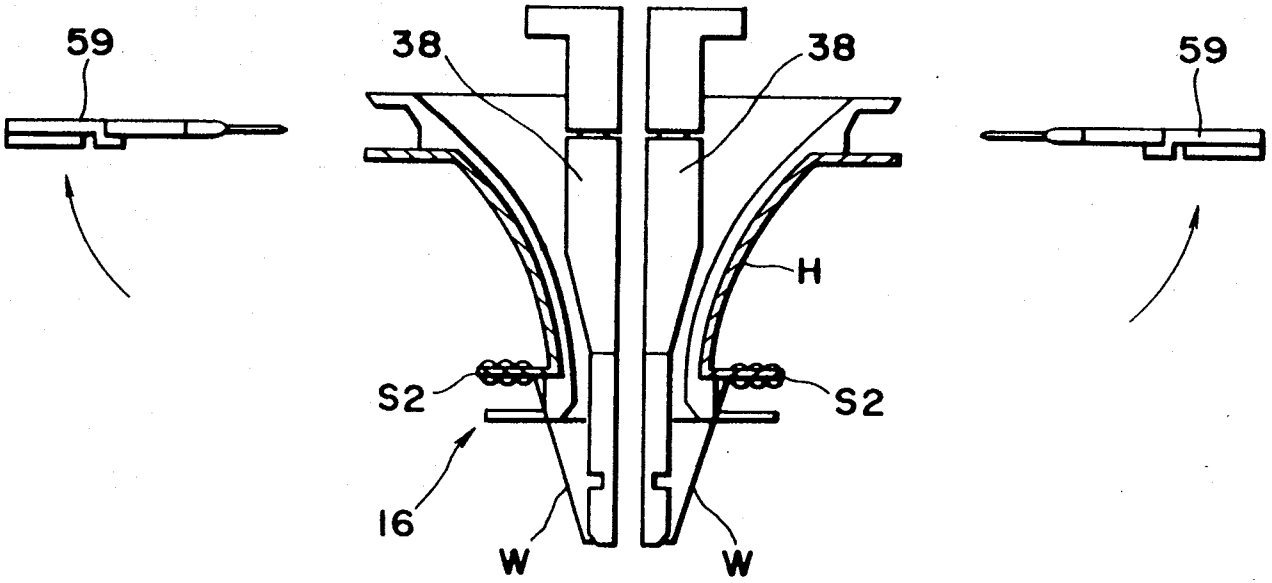
FIG. 24 is a longitudinal sectional view of a core at the beginning of the coil winding operation according to the present invention.

Referring to FIG. 24, first the pair of nozzles 38 are inserted in the core H, the free ends of two wires W are fastened to two of the sections S2 at the small end 16 of the core H, and the pair of guide fingers 59 are positioned in a horizontal position beside the large end 14.

Figure 25:
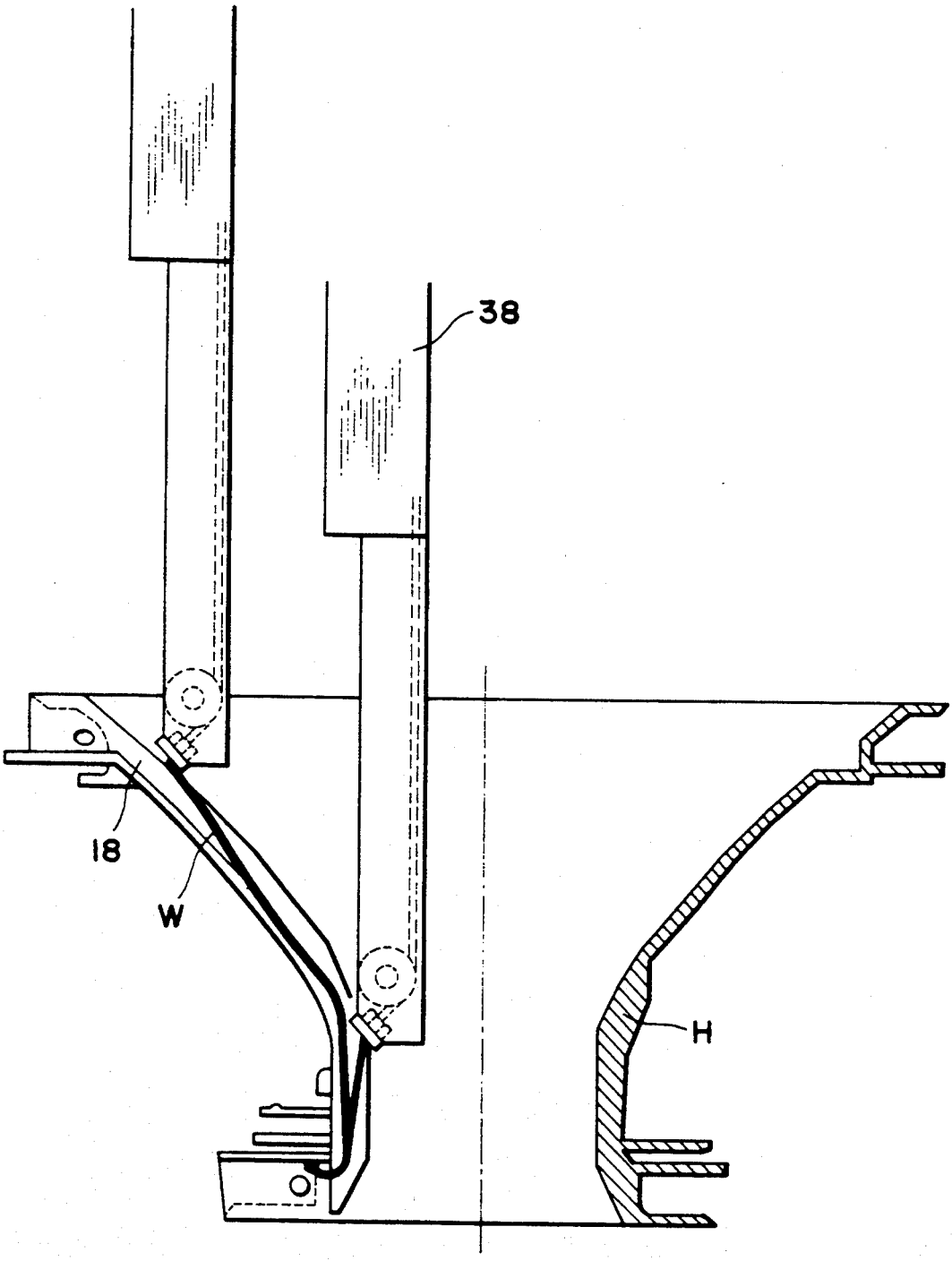
FIG. 25 is a longitudinal sectional view of the core of FIG. 24 with a wire guided inside the core.

Then, as shown in FIG. 25, the core H is rotated for indexing while the pair of nozzles 38 are raised and the wires W are fed so as to extend along the slots 18. The slots 18 as shown more clearly in FIG. 2, and in FIG. 25, only one of the pair of nozzles 38 is shown for simplicity.

Figure 26:
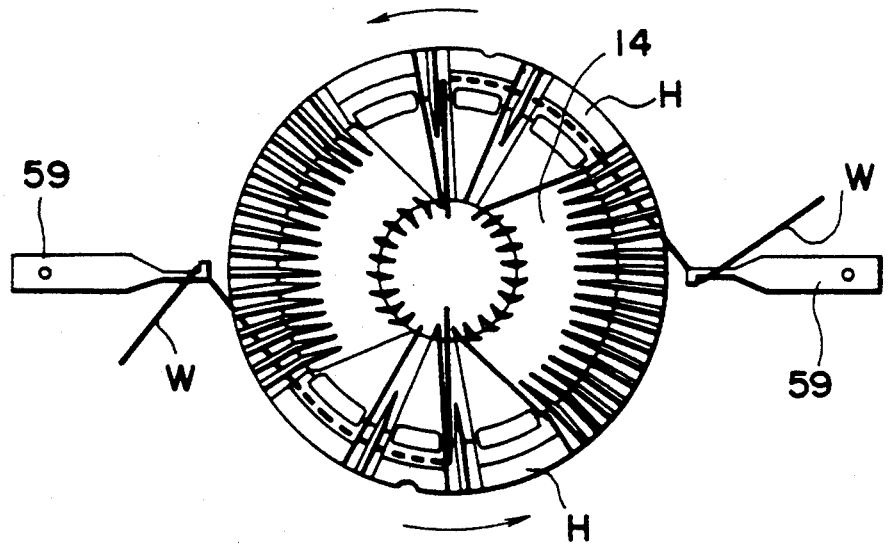
FIG. 26 is a bottom view of the core of FIG. 24 with a wire being wound in a circumferential groove on the side of the larger end of the core.
Figure 27:
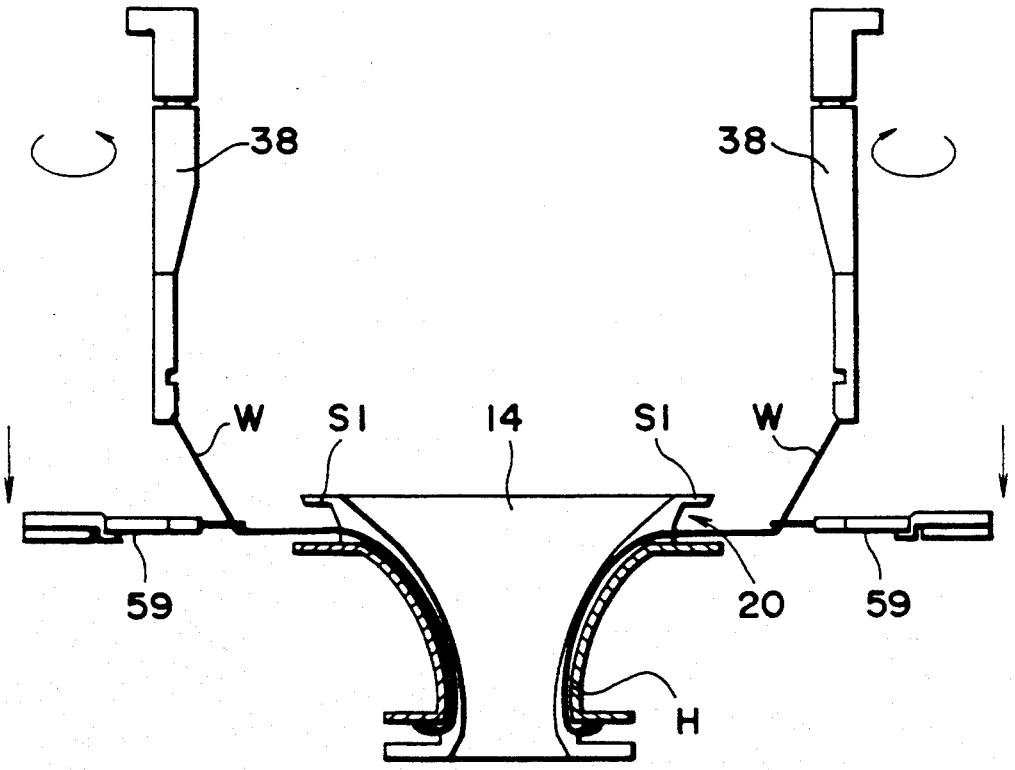
FIG. 27 is a side view of the core of FIG. 24 with a wire being wound in the circumferential groove on the side of the larger end of the core.
Figure 28:
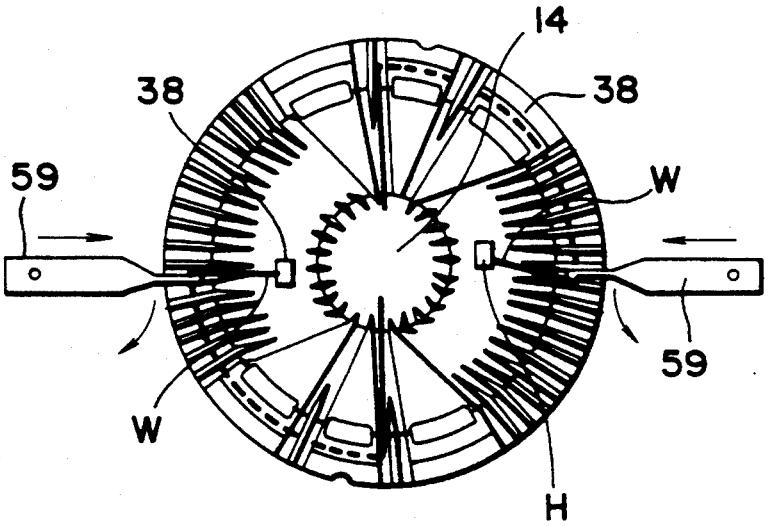
FIG. 28 is a bottom view of the core of FIG. 24 with a wire being wound in one of the sections of the core.
Figure 29:
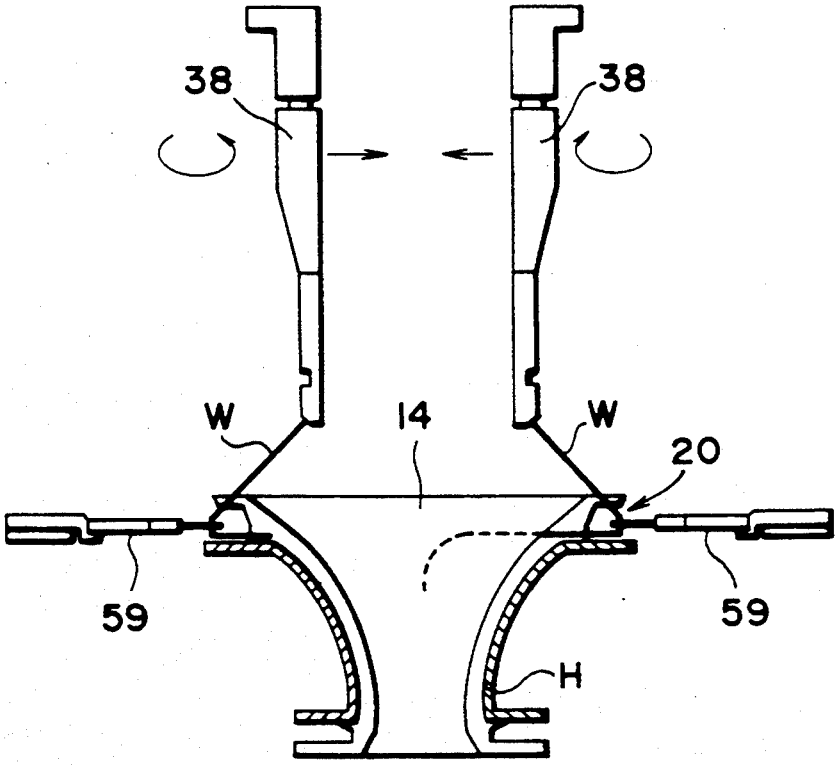
FIG. 29 is a side view of the core of FIG. 24 with wire being wound in one of the sections of the core.

As shown in FIGS. 26 and 27, after the nozzles 38 have been raised to positions where the extremities of the nozzles 38 are positioned on a level above the large end 14 of their core H, the nozzles 38 are turned about the center axes through an angle of 180°. Then, the guide fingers 59 in an open position are advanced toward the core H, and the guide fingers 59 are turned to a closed position to catch the wires W, so that the wires W are held at positions corresponding to the larger circumferential groove 20. Then, the core H is indexed or rotated so that the sections S1 on which the wires W are to be wound are located opposite to the guide fingers 59. As shown in FIGS. 28 and 29, the guide fingers 59 are advanced into the larger circumferential groove 20, the nozzles 38 are advanced toward the center axis of the core H, the nozzles 38 are turned through an angle of −180° relative to the initial positions, and the guide fingers 59 are turned to the open position, so that the wires W are wound on the desired sections S1.

Figure 30:
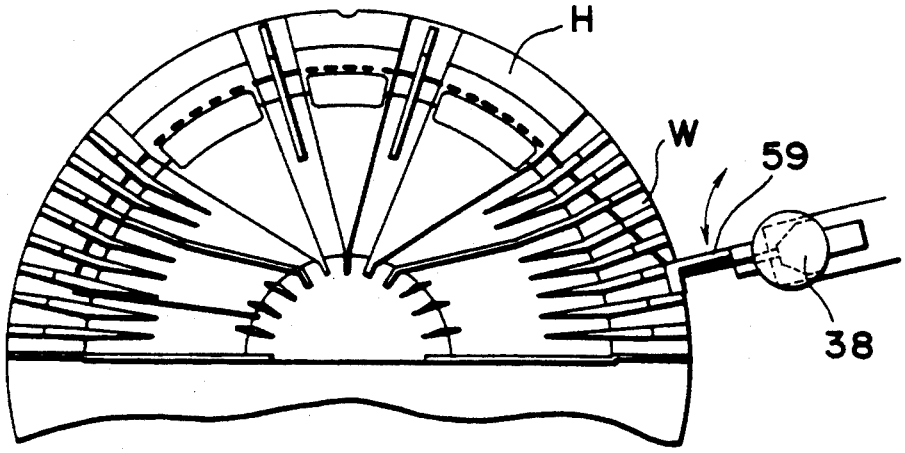
FIG. 30 is a bottom view of the core of FIG. 24 with a wire being guided from the circumferential groove on the side of the larger end of the core through a winding groove to the circumferential groove on the side of the smaller end of the core.
Figure 31:
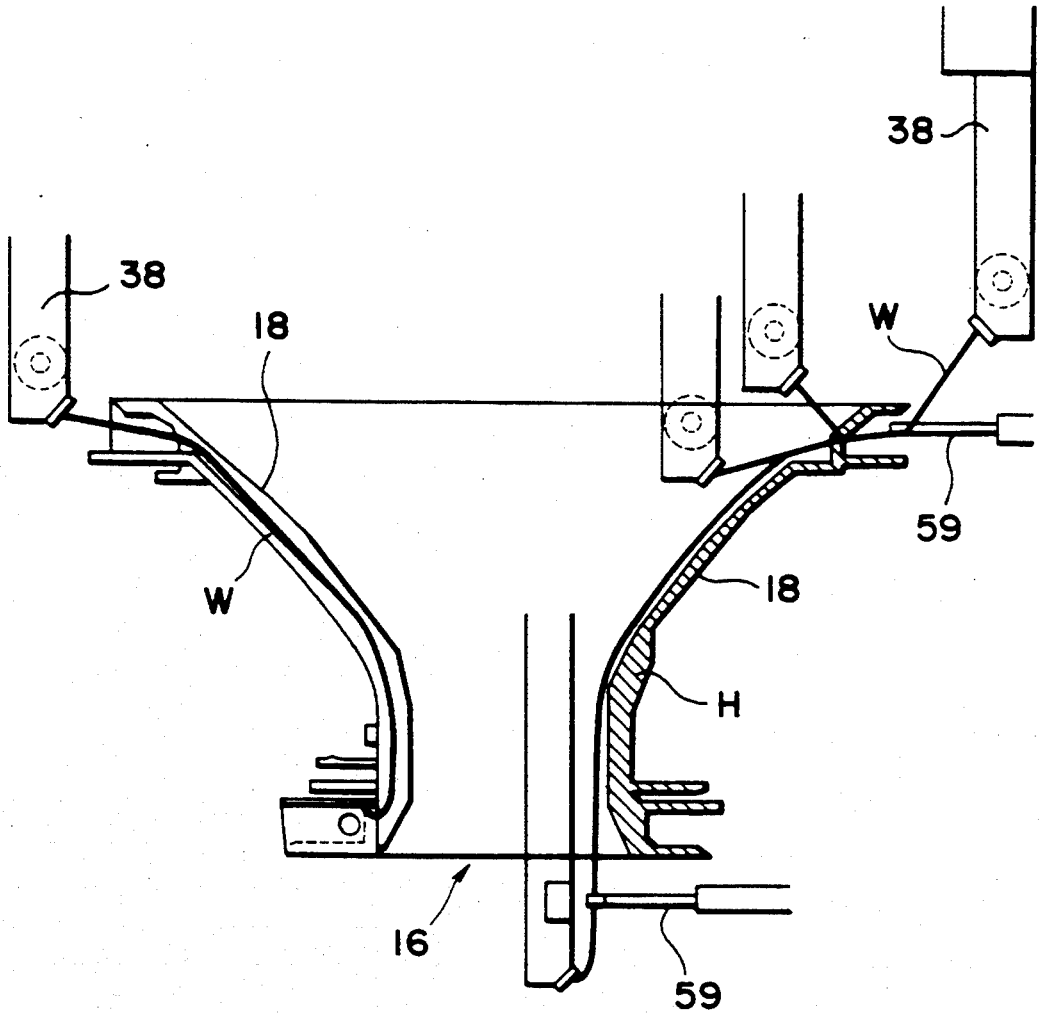
FIG. 31 is a side view of the core of FIG. 24 with a wire being guided from the circumferential groove on the side of the larger end of the core through a winding groove to the circumferential groove on the side of the smaller end of the core.

Then, as shown in FIGS. 30 and 31, the nozzles 38 are lowered again so that the wires W are fed and, at the same time, the core H is rotated. The nozzles 38 move downward along the next slots 18. On the other hand, the guide fingers 59 start moving as soon as they have been opened, the guide fingers 59 are turned through an angle of 180° in the reverse direction as soon as they have reached positions below the smaller end 16 as shown in FIG. 32, and the guide fingers 59 are held at the positions to wait for the nozzles 38.

Figure 32:
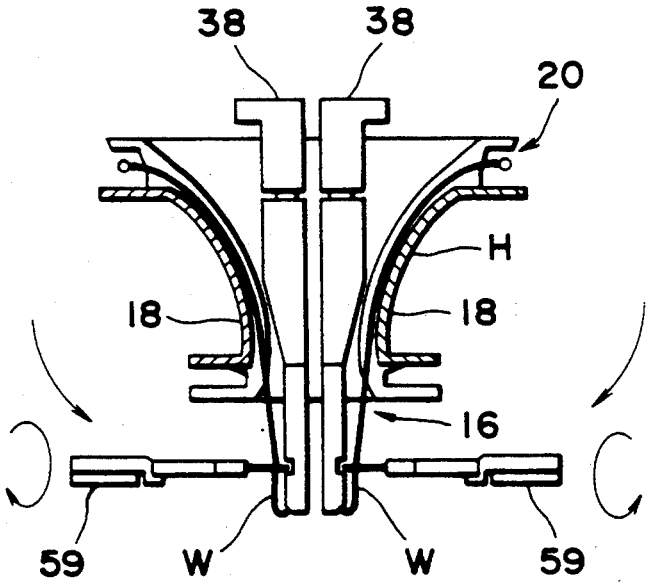
FIG. 32 is a side view of the core of FIG. 24 with a wire caught by the guide finger at the smaller end of the core.
Figure 33:
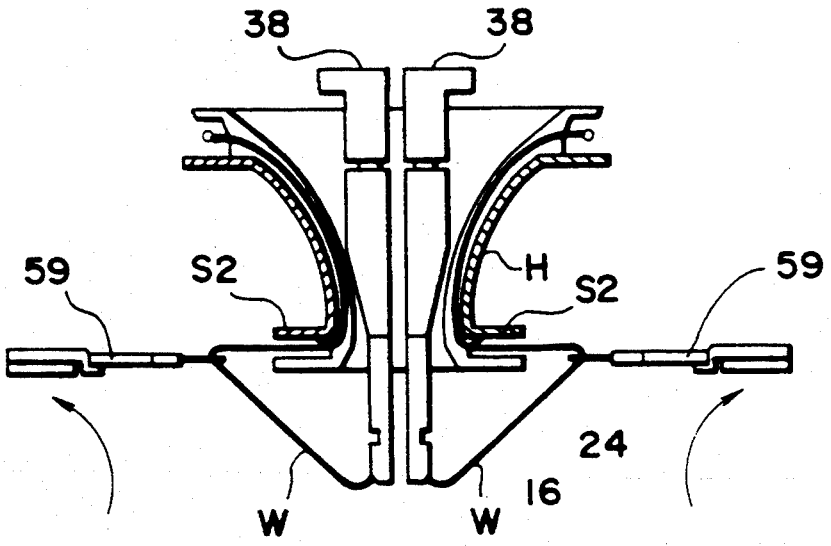
FIG. 33 is a side view of the core of FIG. 24 with a wire guided by the guide finger to a position corresponding to the circumferential groove at the smaller end of the core.
Figure 34:
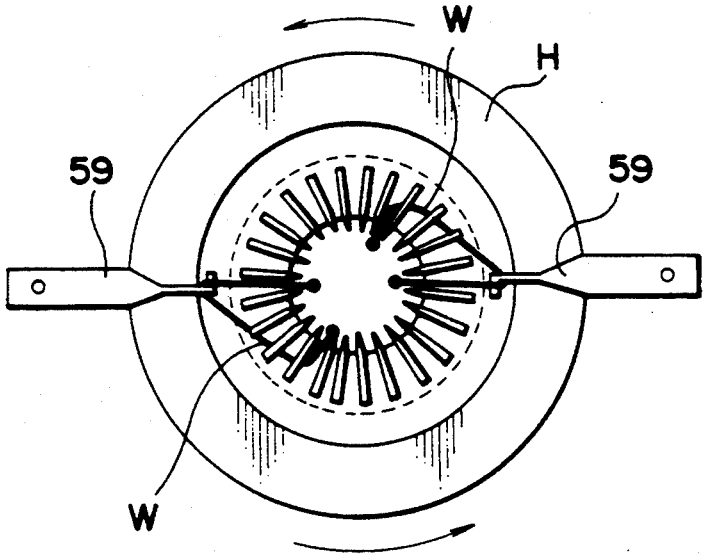
FIG. 34 is a bottom view of the core of FIG. 24 with a wire guided by the guide finger to a position corresponding to the circumferential groove at the smaller end of the core.

As shown in FIGS. 32 through 34, upon the arrival of the nozzles 38 at their lowermost positions, the guide fingers 59 are advanced toward the nozzles 38 to catch the wires W, the guide fingers 59 holding the wires W are retracted and raised to positions corresponding to the smaller circumferential groove 24, as shown in FIG. 33. Then, the core H is indexes to position the sections S2 opposite the guide fingers 59, as shown in FIG. 34.

Figure 35:
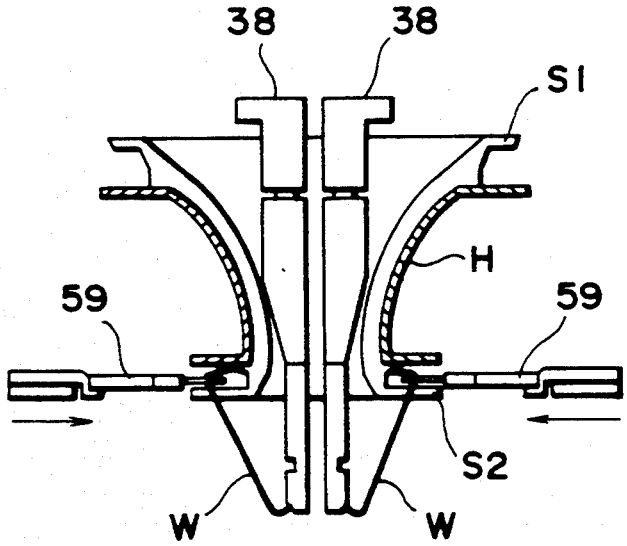
FIG. 35 is a side view of the core of FIG. 24 with a wire guided by the guide finger into the circumferential groove at the smaller end of the core.
Figure 36:
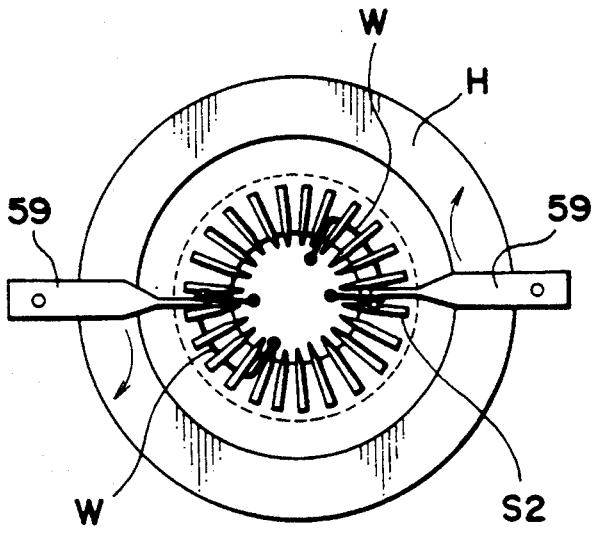
FIG. 36 is a bottom view of the core of FIG. 24 with a wire guided by the guide finger into the circumferential groove at the smaller end of the core.

In FIGS. 35 and 36, the guide fingers 59 are advanced into the smaller circumferential groove 24, and then the guide fingers 59 are turned to the open position to wind the wires W on the desired sections S2.

Figure 37:
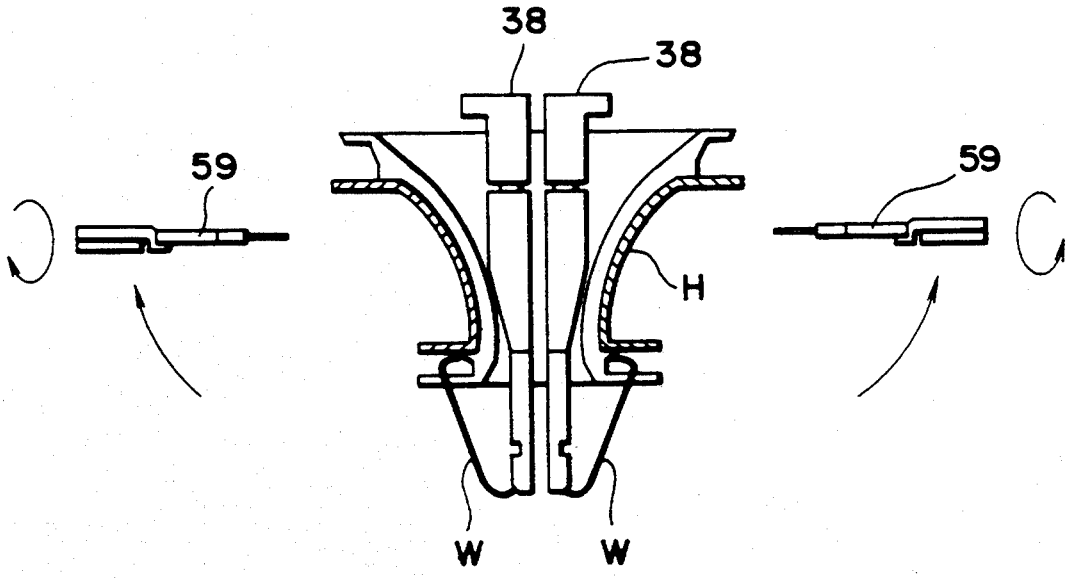
FIG. 37 is a side view of the core of FIG. 24 in which the wire feed nozzle is held at a position at the smaller end of the core.
Figure 38:
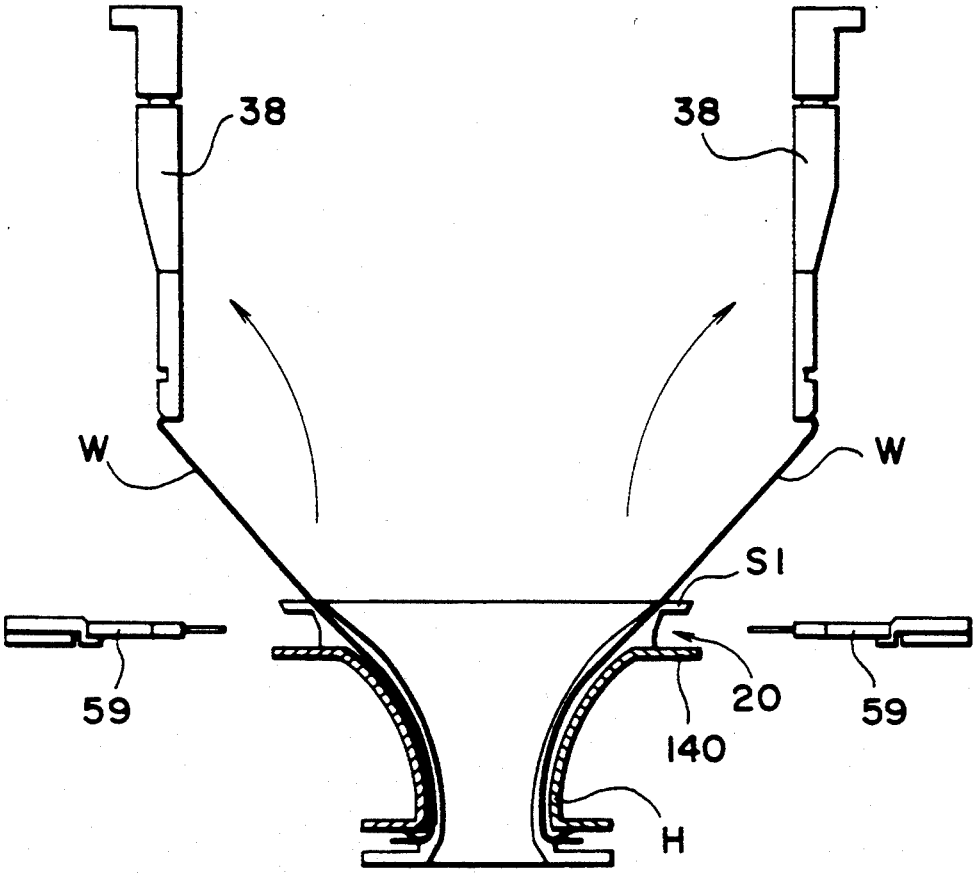
FIG. 38 is a side view of the core of FIG. 24 in which the wire feed nozzle has been moved to a position on the side of the larger end of the core to start the next coil winding cycle.

Then, as shown in FIGS. 37 and 38, the guide fingers 59 are retracted, raised, and then turned in the reverse direction. As shown in FIG. 38, the nozzles 38 are raised in the manner previously described with reference to FIG. 25. Thus, the guide fingers 59 are able to catch and guide the wires W smoothly. This coil winding cycle is repeated to wind the wires W on the core H to form coils.

The coil winding apparatus may be provided with compression coil springs or extension coil springs as means for producing the clamping force, instead of the elastic sliders 107 and 108. The toothed belt 74 and the toothed pulley 160 for turning the rotary table 75 together with the core H to index the core H may be replaced by gears or friction wheels, or the rotary table 75 may be driven for rotation directly by a special motor, such as a hollow motor having a shape resembling the toothed pulley 160.

Figure 39:
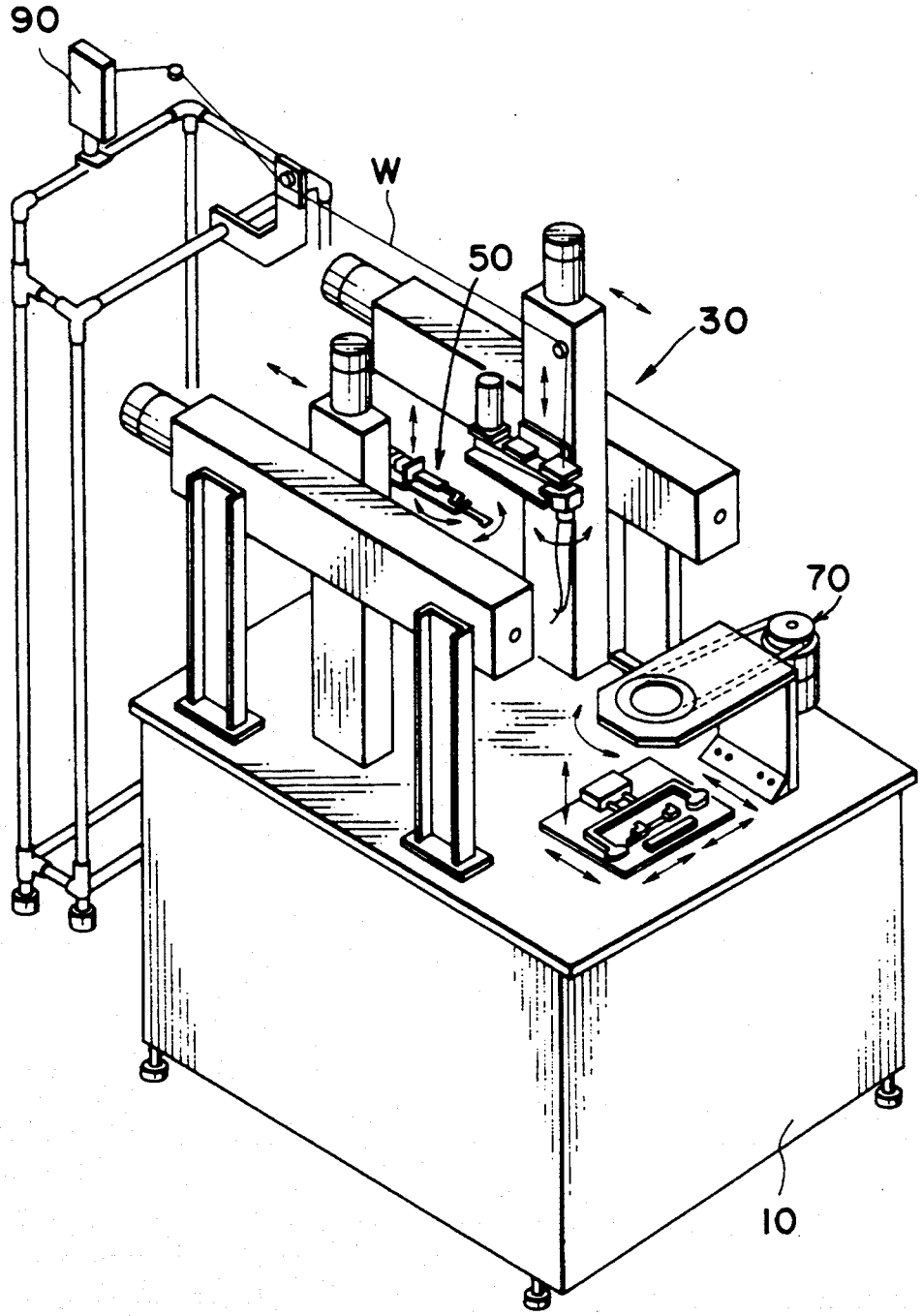
FIG. 39 is a perspective view of a coil winding apparatus according to another embodiment of the present invention.

The coil winding apparatus in the first embodiment shown in FIG. 1 can simultaneously wind at least two wires on the core H. A coil winding apparatus in a second embodiment of the present invention shown in FIG. 39 can wind one wire W on the core H. The latter coil winding apparatus comprises one wire feed unit 30, one guide unit 50, one core holding unit 70, one tension unit 90, and a base frame 10 supporting the foregoing units. This unit needs only a small floor space for installation.

Figure 40:
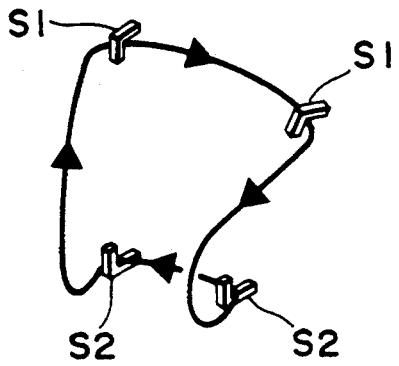
FIG. 40 is a diagrammatic view showing a coil winding path.
Figure 41:
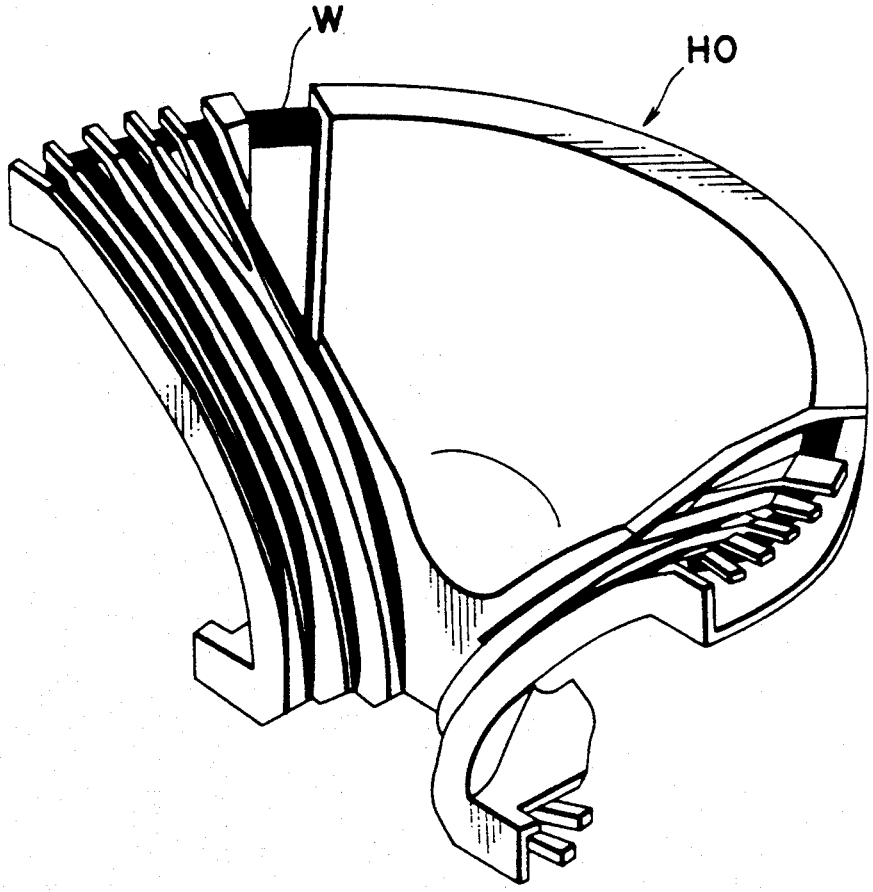
FIG. 41 is a perspective view of a composite deflection yoke formed by the coil winding apparatus of the present invention.

FIG. 40 shows an example of the path of the wire W wound round the sections S1 and S2 of the core H. FIG. 41 shows one of the half members Ho of a composite core H; the half members Ho are put together to form the composite core H similar in shape to the core H shown in FIG. 2.

The operation of the servomotors and the cylinder actuators of the foregoing units are controlled by the NC unit 170. Accordingly, when changing the specification of the deflection yoke to be formed by the coil winding apparatus, the control data can be easily changed by changing the data of the control parameters for numerical control by operating the teaching unit 173. Thus, the mode of operation of the coil winding apparatus can be easily changed in a short time by a simple data changing operation, which improves the productivity of the associated apparatus.

The NC unit 170 for numerically controlling the servomotors and the cylinder actuators may be substituted by other means capable of similar functions, such as a control system comprising a sequence controller and ac servomotors in combination or a control system comprising a CPU and a robot controller in combination.

Having described preferred embodiments of the invention with reference to the accompanying drawings, it is to be understood that the invention is not limited to those precise embodiments and that various changes and modifications could be effected by one skilled in the art without departing from the spirit or scope of the invention as defined in the appended claims.

What is claimed is:

1. A coil winding apparatus for forming coils of a deflection yoke on a core of a hollow and generally cylindrical shape by winding wire in a first circumferential groove of the core, a second circumferential groove of the core and slots formed between the first and second circumferential grooves on the core, the apparatus comprising:

wire feed means for feeding the wire to the core through a wire feed nozzle mounted on a first feed unit for movement along a first axis parallel to a center axis of the core and along a second axis perpendicular to the first axis, said wire feed means being mounted for movement and positioning inside and outside of the core;

guide means having a guiding member for catching the wire fed through the wire feed nozzle and being mounted on a second feed unit for movement along the first and second axes, the guide means being mounted for movement and positioning with respect to the core to guide the wire to the first circumferential groove, the second circumferential groove, and the slots of the core; and core holding means for holding the core and for rotating the core and for positioning the core relative to the wire feed means and the guide means.

2. A coil winding apparatus according to claim 1, wherein said wire feed means includes feed moving means for moving the wire feed nozzle along the first and second axes.

3. A coil winding apparatus according to claim 2, further comprising numerical control means for numerically controlling said feed moving means of said wire feed means.

4. A coil winding apparatus according to claims 1 or 2, wherein said wire feed means includes means for rotating said wire feed nozzle about its center axis through a predetermined angle in one direction and through a predetermined angle in an opposite direction.

5. A coil winding apparatus according to claim 4, further comprising numerical control means for numerically controlling said means for rotating the wire feed nozzle in opposite directions.

6. A coil winding apparatus according to claim 4, wherein said core comprises a large flange formed at a large end of the core and a small flange formed on a small end of the core and wherein said core holding means comprises a clamping device including a positioning mechanism for holding a portion of the core inserted in the clamping device by clamping the held portion between a plurality of rollers, and a securing mechanism to secure the core by pressing the positioning mechanism against one of the large flange or the small flange formed on a small end of the core.

7. A coil winding apparatus according to claim 6, wherein said plurality of rollers comprise a first pair of rollers arranged in a V-shape and a second pair of rollers arranged in a V-shape and opposing said first pair of rollers.

8. A coil winding apparatus according to claim 6, wherein the guiding member of said guide means includes an operating element having a shape substantially in the form of the letter L.

9. A coil winding apparatus according to claim 4, wherein said wire feed nozzle of said wire feed means includes at least one guide pulley having a respective guide groove for guiding the wire.

10. A coil winding apparatus according to claim 1, wherein said guide means includes guide moving means for moving the guiding member along the first and second axes.

11. A coil winding apparatus according to claim 10, further comprising numerical control means for numerically controlling said guide moving means of said guide means.

12. A coil winding apparatus according to claims 1 or 10, wherein the guiding member of said guide means includes mounting means for turning said guide member in one direction and for turning said guide member in an opposite direction with respect to the first and second axes.

13. A coil winding apparatus according to claim 12, wherein said mounting means for turning said guiding member in opposite directions is numerically controlled.

14. A coil winding apparatus according to claim 1, wherein said core holding means comprises a clamping device for detachably holding the core, and a driving means for rotating the clamping device to index the core.

15. A coil winding apparatus according to claim 14, further comprising numerical control means for numerically controlling said driving means for turning the clamping device.

16. A method of winding wires in coils on a core of a hollow and substantially cylindrical shape to form a deflection yoke, said method comprising steps of:

feeding a wire through a movable wire feed nozzle;

moving the wire feed nozzle along a first axis parallel to a center axis of the core and a second axis perpendicular to the first axis, said moving being performed both inside and outside of the core;

rotating the wire feed nozzle about its central axis;

detachably catching the wire fed through the wire feed nozzle with a movable guide member and moving the guide member along the first and second axes; and rotating the core for winding the wire on the core in a first circumferential groove thereof, a second circumferential groove thereof, and a slot extending between the first and second circumferential grooves of the core.

17. A method of winding wires in coils on a core to form a deflection yoke according to claim 16, wherein the steps of the movement of the wire feed nozzle along the first and second axes, the turning of the wire feed nozzle, the movement of the guide member along the first and second axes, and the turning of the core are numerically controlled.

18. A method of winding wires in coils on a core to form a deflection yoke according to claim 17, further comprising the step of holding the core at a portion thereof by a plurality of rollers.

* * * * *